US011788014B2

(12) United States Patent
Garner et al.

(10) Patent No.: US 11,788,014 B2
(45) Date of Patent: Oct. 17, 2023

(54) HIGH TEMPERATURE PARAFFINIC FROTH TREATMENT PROCESS

(71) Applicant: CANADIAN NATURAL RESOURCES LIMITED, Calgary (CA)

(72) Inventors: William Nicholas Garner, Calgary (CA); Alvaro Blanco, Calgary (CA); Guillaume Viguie, Calgary (CA); Randy Paine, Calgary (CA); Jiangying Wu, Calgary (CA); Julio Gomez, Calgary (CA); Eduardo Fernandez, Calgary (CA); Matthew Armour, Calgary (CA)

(73) Assignee: CANADIAN NATURAL RESOURCES LIMITED, Calgary (CA)

( * ) Notice: Subject to any disclaimer, the term of this patent is extended or adjusted under 35 U.S.C. 154(b) by 54 days.

(21) Appl. No.: 17/176,378

(22) Filed: Feb. 16, 2021

(65) Prior Publication Data

US 2021/0163826 A1 Jun. 3, 2021

Related U.S. Application Data

(62) Division of application No. 16/105,764, filed on Aug. 20, 2018, now Pat. No. 10,954,448.

(60) Provisional application No. 62/547,278, filed on Aug. 18, 2017.

(51) Int. Cl.
*C10G 1/04* (2006.01)

(52) U.S. Cl.
CPC ..... *C10G 1/045* (2013.01); *C10G 2300/206* (2013.01); *C10G 2300/4081* (2013.01); *C10G 2300/44* (2013.01)

(58) Field of Classification Search
None
See application file for complete search history.

(56) References Cited

U.S. PATENT DOCUMENTS 2,895,908 A * 7/1959 Beavon ..... C10G 21/16 208/321
2,907,709 A * 10/1959 Benedict ..... C10G 73/06 208/31
2,943,050 A * 6/1960 Beavon ..... C10G 21/003 208/309

(Continued)

*Primary Examiner* — Tam M Nguyen
(74) *Attorney, Agent, or Firm* — Parlee McLaws LLP

(57) ABSTRACT

A high temperature paraffinic froth treatment (HTPFT) process utilizes an unheated flash vessel as a first stage of solvent recovery in a paraffinic solvent recovery unit (PSRU) to minimize asphaltene precipitation and fouling in subsequent stages of solvent recovery. The HTPFT may utilize a heat pump circuit for heat integration in the PSRU where a first stage of solvent recovery is at a lower temperature than a second stage of solvent recovery. Froth entering froth separation vessels can be heated using heat in a tailings stream using a heat pump. Froth separation vessels used to separate froth for collecting a bitumen-containing overflow utilize a collector pot and conventional feedwell combination, or a combination of a collection ring and nozzle arrangement for reducing disturbance in the vessel and improving collection of the overflow.

19 Claims, 26 Drawing Sheets
(2 of 26 Drawing Sheet(s) Filed in Color)

(56) References Cited

U.S. PATENT DOCUMENTS

| | | | | |
|---|---|---|---|---|
| 4,214,975 | A * | 7/1980 | Davis | C10G 21/28 208/33 |
| 4,305,814 | A * | 12/1981 | Leonard | C10C 1/18 208/309 |
| 4,342,646 | A * | 8/1982 | Sherman | C10G 21/28 208/326 |
| 4,840,721 | A * | 6/1989 | Kaines | C10G 45/02 208/101 |
| 10,577,269 | B1 * | 3/2020 | Bader | C02F 1/004 |
| 2009/0223862 | A1 * | 9/2009 | MacDonald | B01D 3/10 208/184 |
| 2012/0110897 | A1 * | 5/2012 | Forrest | C07C 67/03 44/307 |
| 2012/0184789 | A1 * | 7/2012 | Ackerson | C10G 49/00 585/242 |
| 2014/0083911 | A1 * | 3/2014 | Van Der Merwe | C10G 1/042 208/390 |
| 2017/0029724 | A1 * | 2/2017 | Koseoglu | C10G 9/005 |
| 2019/0055474 | A1 * | 2/2019 | Garner | C10G 1/045 |
| 2021/0246389 | A1 * | 8/2021 | Koseoglu | B01J 35/1038 |

* cited by examiner

HIGH TEMPERATURE PARAFFINIC FROTH TREATMENT PROCESS

CROSS REFERENCE TO RELATED APPLICATIONS

This application is a divisional of U.S. patent application Ser. No. 16/105,764, filed on Aug. 20, 2018 now U.S. Pat. No. 10,954,448, which claims the benefit under 35 U.S.C 119(e), of U.S. Provisional Application 62/547,278, filed Aug. 18, 2017, and the file contents of each is expressly incorporated herein by reference in their entirety.

FIELD

Embodiments taught herein relate to processing of a bitumen-containing froth to produce a bitumen product and, more particularly, are related to a high temperature paraffinic froth treatment process.

BACKGROUND

Canada has a wealth of heavy oil and bitumen available for extraction by various means and conversion into a variety of useful and valuable products: fuels, plastics, fertilizer. Some of this oil is best removed from its sandy substrate through mining techniques, which are less energy intensive than most in-situ or conventional extraction techniques. Most mined oil sands are extracted using a version of the warm water washing process described in Canadian Patent 448,231 to Clark, producing "froth"—bitumen droplets suspended in mineral laden water with a typical composition in the range of 60% bitumen, 30% water and 10% mineral.

Alternatives to warm water extraction include a solvent extraction process, which is described in an Environment Canada Report (1994). Alternatively, a thermal extraction process can be used, which is similar to the Alberta Taciuk Process described in U.S. Pat. No. 4,180,455.

A variety of technologies have been used over time for cleaning the "froth" to remove the residual water and mineral, making it suitable for further processing using conventional oil refining techniques. The conventional oil business uses custom treating for an equivalent purpose—typically heating the mixture and adding chemistry which will break emulsions and flocculate minerals, which can then settle by gravity. The most conventional froth treatment process involves the addition of a diluent (naphtha) to invert the emulsion and reduce the density and viscosity of the oil phase, followed by gravity settling in various forms (naphthenic froth treatment process). In some cases, chemistry has also been added to break emulsions or flocculate minerals from oil sand froth, as is described in a paper titled "Process reagents for the enhanced removal of solids and water" (Madge, 2005).

In the early 1990's, it was noted that incompatibility with some diluents, in the case of Athabasca bitumens, resulted in the precipitation of a portion of the asphaltene fraction of the oil. Further, it was noted that the incompatibility also resulted in the breaking of emulsions and the agglomeration of gangue material into readily settling particles. The process became the paraffinic froth treatment process as outlined in Canadian Patent 2,149,737 to Syncrude. In parallel, refiners have looked at partial upgrading of residues through a related precipitation in what is called the ROSE process, described in published PCT Application WO2007/001706 to Iqbal et al. Both the Syncrude and the ROSE processes use a paraffinic solvent to precipitate some, if not all, of the asphaltene present in the heavy oil (fraction), as defined by the Hildebrand or Hansen solubility parameters.

In practice, an early version of the paraffinic froth treatment process implemented in oil sands was a low temperature paraffinic froth treatment (LTPFT) plant installed at the Albian Sands Facility in northern Alberta, Canada. The process is described in Canadian Patent 2,588,043 to Shell Canada Energy. Further research resulted in the development of a high temperature paraffinic froth treatment (HTPFT) process, which produced better agglomerates that were tighter, denser and less susceptible to damage by shear forces, as described in Canadian Patent 2,454,942 to TrueNorth Energy Corp., currently owned by Fort Hills Energy LP. The HTPFT process is the root of a series of designs that have since been installed at Jackpine, Kearl Lake and Fort Hills, all in northern Alberta, Canada. Each of these installations has included some modifications and improvements upon the base design that suit the operators and situations of the facilities.

There continues to be interest in further improvements to the HTPFT process resulting in more cost effective and efficient treatment of froth.

SUMMARY

Embodiments taught herein improve upon a conventional high temperature paraffinic froth treatment process and vessels for froth separation used therein. The solvent-diluted bitumen from a countercurrent froth separation unit is stabilized against asphaltene precipitation. In a paraffinic solvent recovery unit a first stage of solvent recovery utilizes an unheated flash vessel. Stabilizing is achieved by removal of a portion of the solvent content therein. Removing solvent without heating avoids taking the mixture through a precipitation horizon. The removal of the portion of solvent reduces fouling in downstream stages of solvent recovery. Further, in a unique manner, a heat pump circuit is associated with the first stage of solvent recovery at a first temperature and a second stage of recovery at a higher temperature to provide significant heat integration. The overhead stream from the second heated stage is used to heat the underflow from the first stage as feed to the second stage of solvent recovery. More specifically, the first stage of recovery uses an unheated flash vessel and the second stage uses a heated flash vessel. The overhead solvent vapour stream from the heated flash vessel acts as an intermediate fluid in the heat pump circuit to heat the underflow from the unheated flash vessel. Further, in embodiments, a heat pump is used to heat the froth entering the froth separation unit using heat in a tailings stream from a tailings solvent recovery unit.

In embodiments, the froth separation vessels utilize a collector pot in combination with a conventional feedwell, or a collector ring in combination with a nozzle arrangement to reduce disturbance within the vessels for improving separation and collection of overflow therein.

In one broad aspect, a high temperature paraffinic process (HTPFT) utilizes a counter-current froth separation unit (FSU) having first and second FSU vessels for separating a paraffinic solvent-diluted froth stream, at an operating temperature from about 60° C. to about 130° C., into first overflow stream from the first FSU vessel, comprising at least partially de-asphalted solvent-diluted bitumen, and an underflow stream from the second FSU vessel, comprising at least solids, precipitated asphaltenes, water and residual paraffinic solvent. A paraffinic solvent recovery unit (PSRU)

recovers paraffinic solvent from the first FSU's overflow stream for reuse in the HTPFT and for recovering a partially de-asphalted bitumen-containing underflow product stream for delivery downstream thereof. A tailings solvent recovery unit (TSRU) comprising at least one TSRU vessel removes at least a portion of residual paraffinic solvent from the underflow stream from the second FSU vessel for producing a solvent-containing overflow stream for reuse in the HTPFT and a tailings underflow stream for disposal. A vapour recovery unit (VRU) separates at least residual paraffinic solvent from overhead streams from the FSU vessels, the PSRU vessels and the TSRU vessels. The process in the PSRU comprises flashing the first overflow stream from the first FSU vessel in an unheated flash vessel for producing a first overhead solvent-containing stream and a first underflow stream, being a partially de-asphalted solvent-diluted bitumen stream, wherein flashing of at least a portion of the paraffinic solvent from the first overflow stream without the addition of heat shifts the solubility of asphaltenes therein for minimizing further de-asphalting thereof downstream in the PSRU.

In another broad process aspect, a process of heat integration in a solvent recovery unit having a first flash vessel, operating at a first temperature, and a second flash vessel, operating at a second temperature higher than the first temperature, comprises flashing a solvent-containing feed stream in the first vessel for producing a first overhead solvent vapour stream; and a first underflow stream. The first underflow stream is fed to the second flash vessel. The first underflow is flashed in the second flash vessel for producing a second, overhead solvent vapour stream; and a second underflow stream. The second, overhead solvent vapour stream is passed through a heat pump circuit for heating the first underflow stream prior to feeding the first underflow stream to the second flash vessel, wherein the second, overhead solvent vapour stream acts as an intermediate fluid in the heat pump circuit for exchanging heat therein to the first underflow stream.

In yet another broad aspect, a process of heat integration in a paraffinic solvent recovery unit comprises flashing a paraffinic solvent-diluted bitumen feed in a first unheated flash vessel for producing a first overhead solvent vapour stream, comprising at least a portion of the paraffinic solvent; and an underflow stream comprising residual solvent and bitumen therein. The underflow stream is flashed in a second heated flash vessel for recovering a portion of the solvent therein and producing a second overhead solvent vapour stream; and a second underflow stream comprising residual solvent and bitumen therein. The second overhead solvent vapour stream is compressed to force a temperature of condensation therein to be above a bulk evaporation temperature of the first underflow stream. The compressed second overhead solvent vapour stream is condensed against the first underflow stream for heating the first underflow stream therewith prior to feeding the heated underflow stream to the second heated flash vessel.

In yet another broad process aspect, a high temperature paraffinic process (HTPFT) utilizes a counter-current froth separation unit (FSU) having first and second FSU vessels for separating a paraffinic solvent diluted froth stream, at an operating temperature from about 60° C. to about 130° C., into a paraffinic solvent-diluted bitumen overflow stream from the first FSU vessel, comprising at least partially de-asphalted bitumen and the paraffinic solvent, and an underflow stream from the second FSU vessel, comprising at least solids, water and residual paraffinic solvent. A paraffinic solvent recovery unit (PSRU) recovers at least a portion of the paraffinic solvent from the paraffinic solvent-diluted bitumen overflow stream for reuse in the HTPFT and a partially de-asphalted bitumen containing product stream for delivery downstream thereof. A tailings solvent recovery unit (TSRU) comprising at least one TSRU vessel removes at least a portion of the residual paraffinic solvent from the underflow stream from the second FSU vessel for producing a solvent containing overflow stream for reuse in the HTPFT and a tailings underflow stream. A vapour recovery unit (VRU) separates at least residual paraffinic solvent from the FSU, the PSRU and the TSRU. The process comprises heating a froth stream for delivery to the first FSU vessel prior to the addition of paraffinic solvent thereto and to the first FSU vessel using a heat pump.

In a broad apparatus aspect, a froth separation vessel for a high temperature paraffinic froth treatment process comprises a vessel having a cylindrical portion, a conical bottom and a semispherical top. An inlet pipe extends substantially vertically within a center of the vessel from the top to about a transition between the cylindrical portion and the conical bottom. A feedwell fluidly connects to a bottom of the inlet pipe for delivering paraffinic solvent-diluted bitumen-containing froth to the vessel. A collector pot is supported concentrically about the inlet pipe, at or about a top of a separation zone in the cylindrical portion, for collecting and discharging an overflow stream therefrom. A surge volume is in the cylindrical portion above the separation zone; and an outlet is in the conical bottom for discharging an underflow stream therefrom.

In another broad apparatus aspect, a froth separation vessel for a high temperature paraffinic froth treatment process comprises a vessel having a cylindrical portion, a conical bottom and a semispherical top. An inlet pipe extends substantially vertically within a center of the vessel from the top to about a transition between the cylindrical portion and the conical bottom. A nozzle arrangement fluidly connects to a bottom of the inlet pipe for delivering paraffinic solvent-diluted bitumen-containing froth to the vessel. A collector ring is supported toroidally about the inlet pipe, at or about a top of a separation zone in the cylindrical portion, for collecting and discharging an overflow stream therefrom. A surge volume is in the cylindrical portion above the separation zone; and an outlet is in the conical bottom for discharging an underflow stream therefrom.

BRIEF DESCRIPTION OF THE DRAWINGS

The patent or application file contains at least one drawing executed in color. Copies of this patent or patent application with color drawing(s) will be provided by the Office upon request and payment of the necessary fee.

FIG. 2A is a process diagram of the overall HTPFT according to embodiments taught herein;

FIG. 2B is a process flow diagram of the froth separation unit (FSU) of the HTPFT according to FIG. 2A;

FIG. 2C is a process flow diagram of the paraffinic solvent recovery unit (PSRU) of the HTPFT according to FIG. 2A;

FIG. 2D is a process flow diagram of the tailings solvent recovery unit (TSRU) of the HTPFT according to FIG. 2A; and FIG. 2E is a process flow diagram of the vapor recovery unit (VRU) of the HTPFT according to FIG. 2A;

FIG. 3A is a process diagram of the overall HTPFT according to embodiments taught herein;

FIG. 3B is a process flow diagram of the froth separation unit (FSU) of the HTPFT according to FIG. 3A;

FIG. 3C is a process flow diagram of the paraffinic solvent recovery unit (PSRU) of the HTPFT according to FIG. 3A;

FIG. 3D is a process flow diagram of the tailings solvent recovery unit (TSRU) of the HTPFT according to FIG. 3A; and FIG. 3E is a process flow diagram of the vapor recovery unit (VRU) of the HTPFT according to FIG. 3A;

DESCRIPTION

Prior Art

Figure 1:
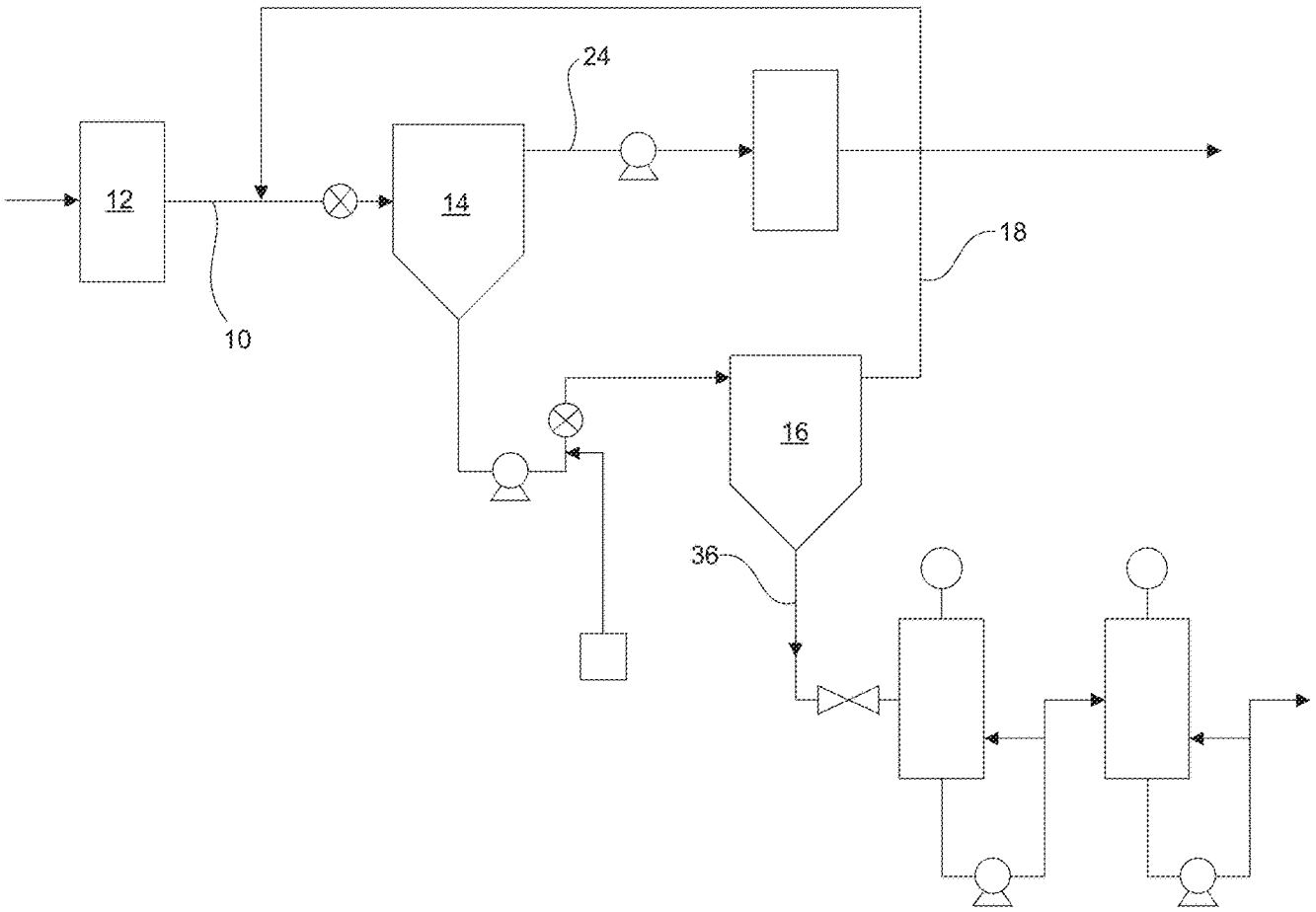
Fig. 1 PRIOR ART
FIG. 1 is a schematic flowsheet illustrating a prior art, high temperature, paraffinic froth separation circuit according to Canadian Patent 2,454,942.

Applicant's high temperature paraffinic froth treatment process (HTPFT) is based on a similar process and process flow diagram as in the HTPFT process outlined in Canadian Patent 2,454,942 and shown in prior art FIG. 1, relabeled in accordance with embodiments taught herein. The first stage of the HTPFT is a counter-current solvent extraction and separation, which uses the incompatibility of asphaltenes in the bitumen with paraffinic solvents to achieve partial solvent de-asphalting of the bitumen, coalescence/settling of the water and agglomeration of the mineral separated in a counter-current manner through the first and second separation vessels 14, 16. In the two-stage countercurrent separation system, the first froth separation vessel 14 receives the froth 10 combined with an overflow stream 18 from the second vessel 16, containing at least solvent-diluted bitumen. The underflow from the first FSU vessel 14 provides the feed to the second FSU vessel 16. Overflow from the first FSU vessel 14 comprises at least bitumen and solvent and the underflow 36 from the second FSU vessel 16 comprises solids, precipitated asphaltenes, water and residual solvent, all of which are subject to downstream processing.

Improvements to the prior art process, from a performance, economic and/or risk perspective, are described herein with reference to embodiments of the process shown in FIGS. 2A to 2E and 3A to 3E.

Figure 2A:
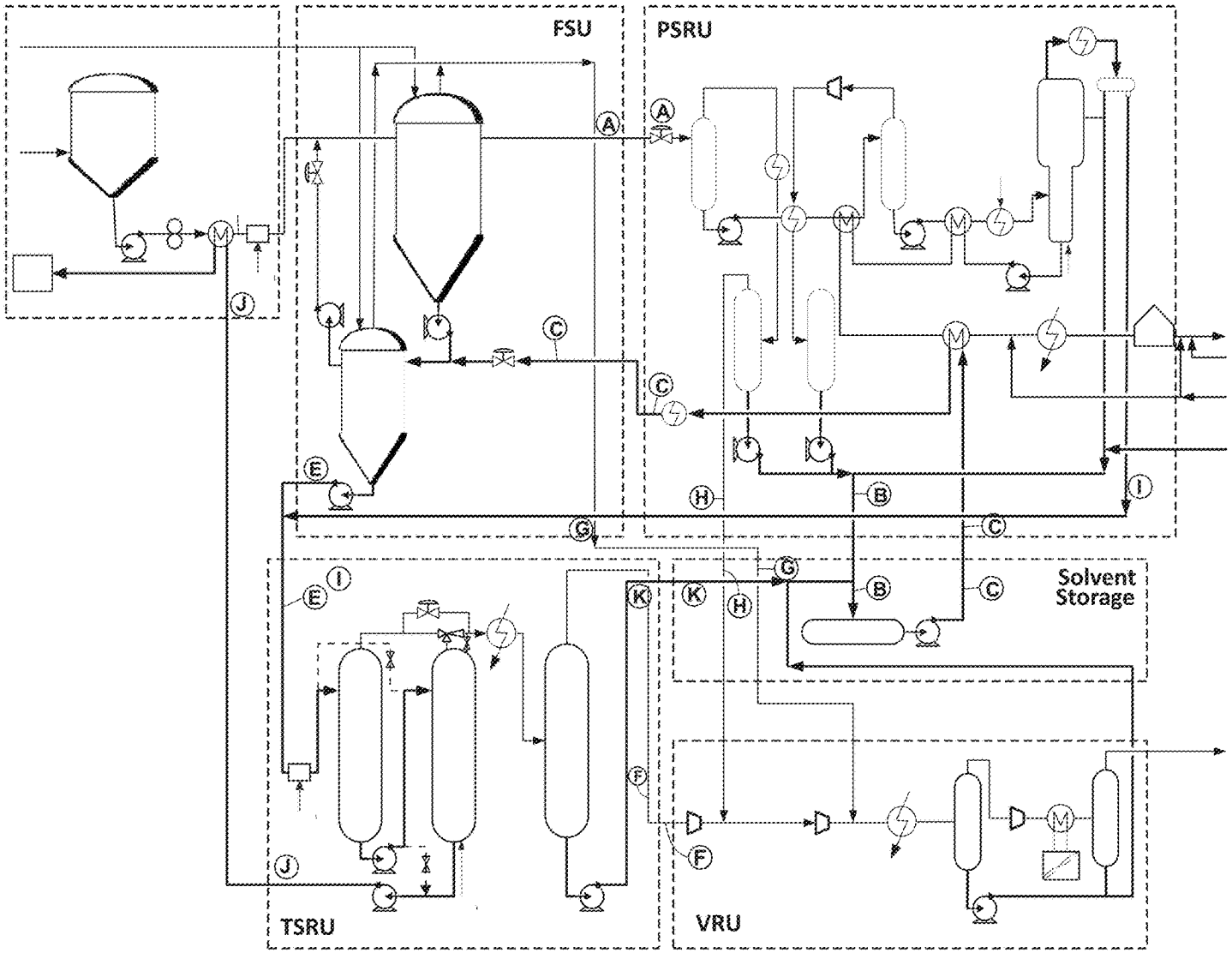
FIGS. 2A to 2E are process flow diagrams of a high temperature, paraffinic froth treatment (HTPFT) process according to embodiments taught herein, more particularly.
Figure 2B:
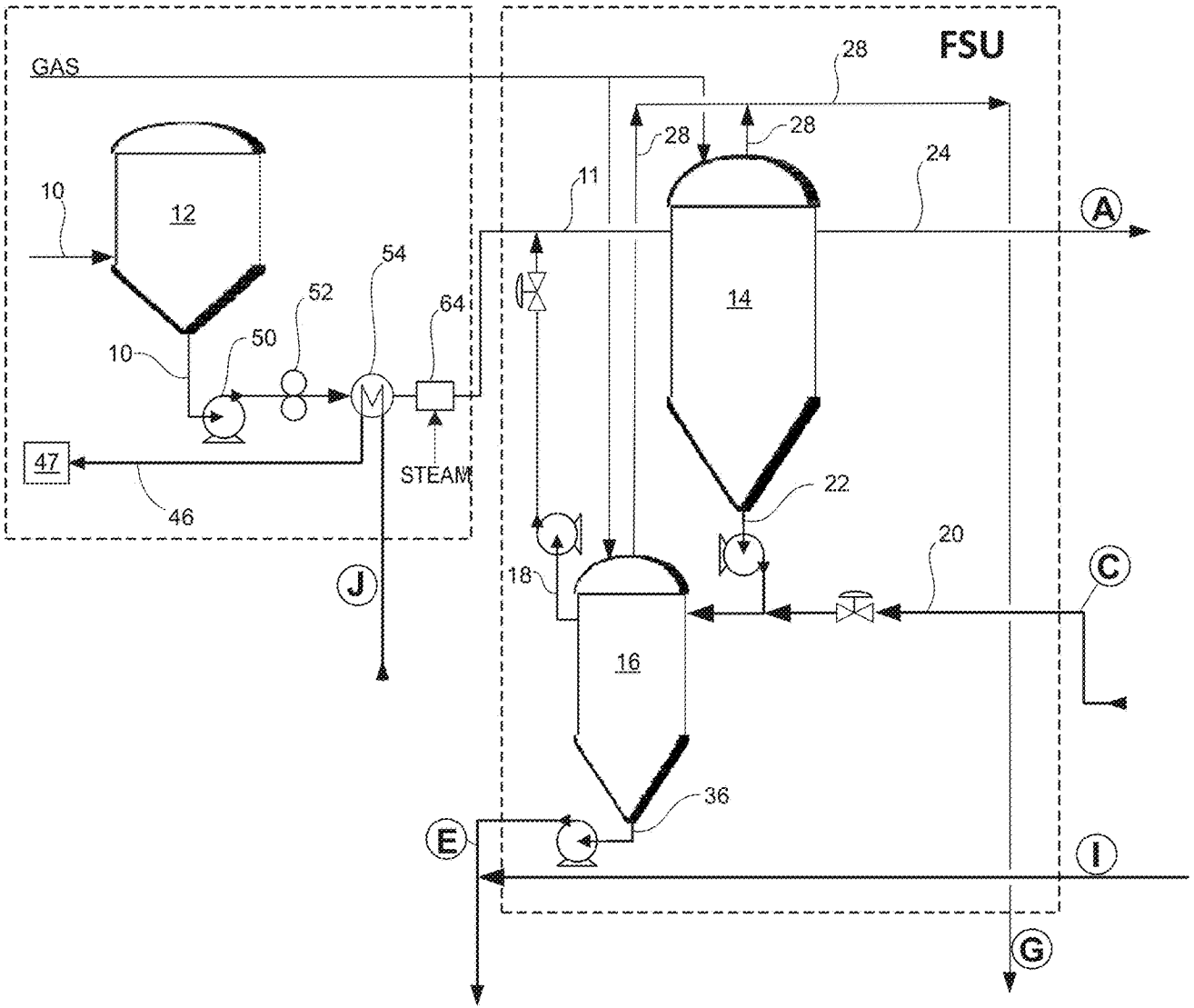
Figure 2C:
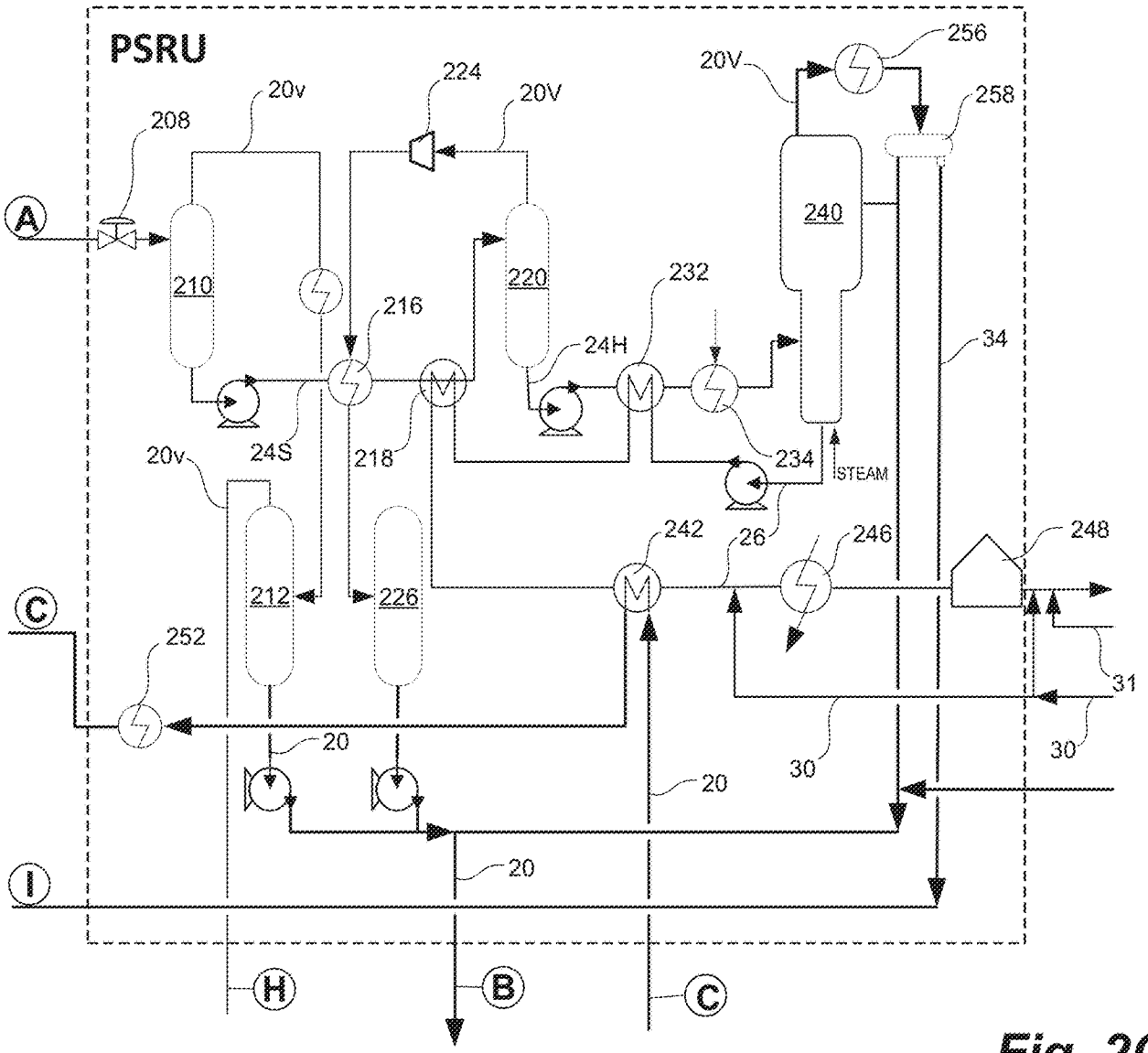
Figure 2D:
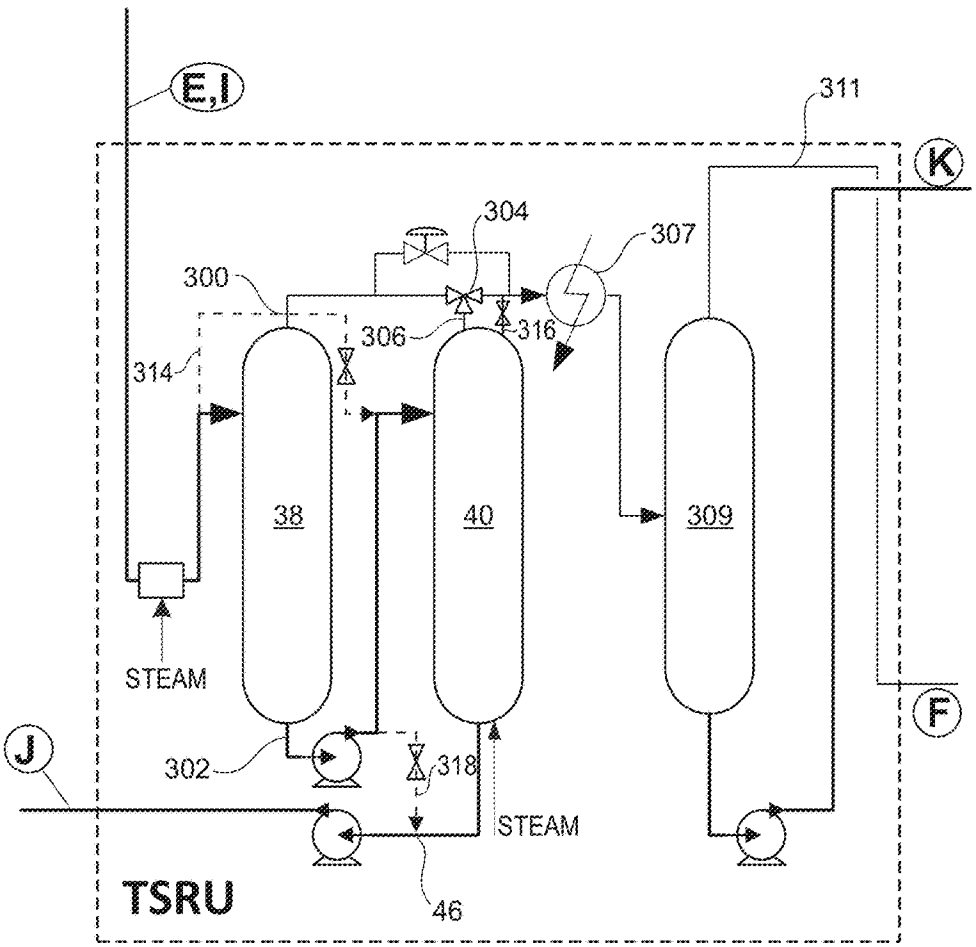
Figure 2E:
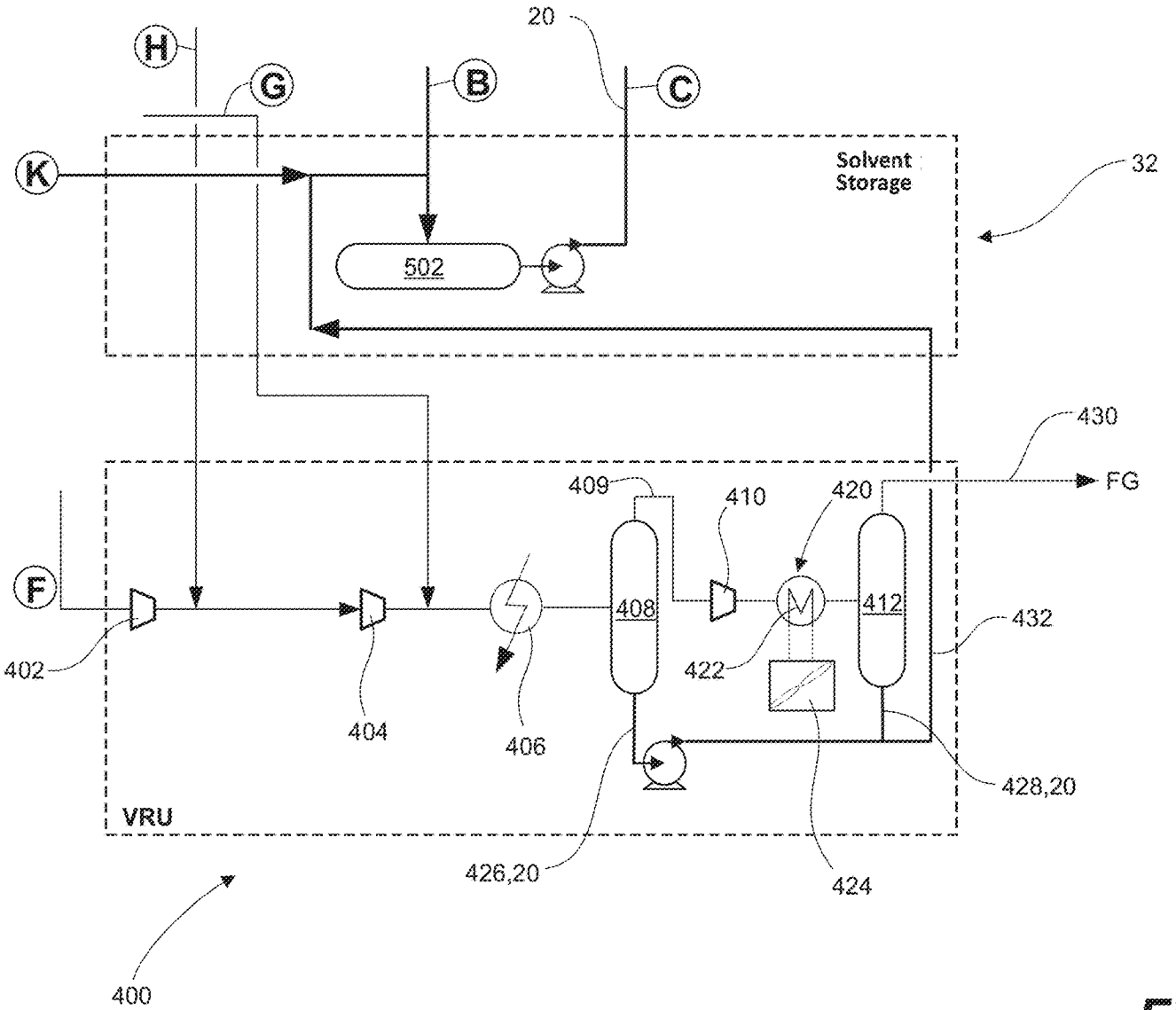
Figure 3A:
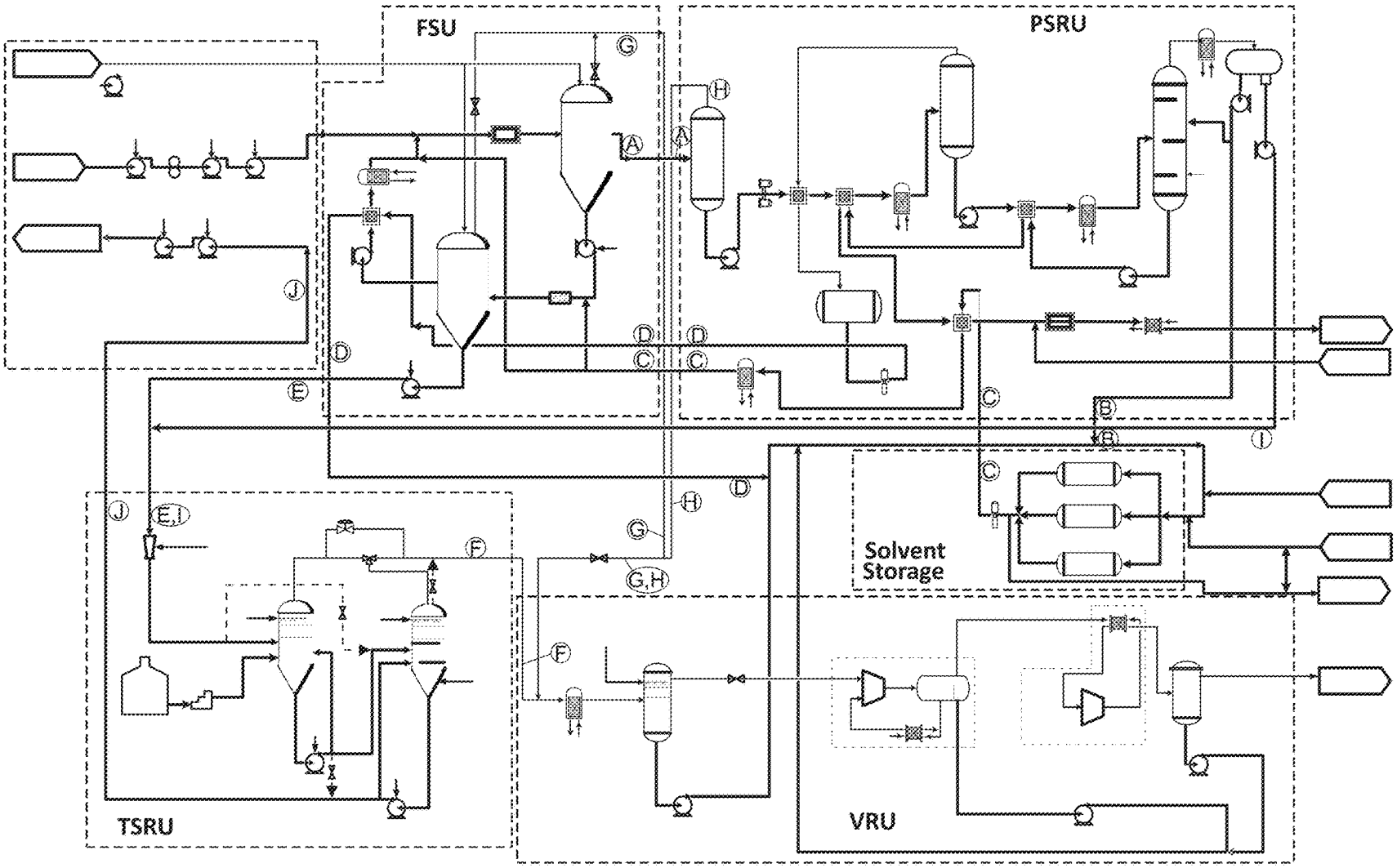
FIGS. 3A to 3E are process flow diagrams of a high temperature, paraffinic froth treatment process according to alternate embodiments taught herein, more particularly.

Generally, with reference to FIGS. 2A and 3A, which illustrate two different embodiments, the HTPFT process disclosed herein provides a Froth Separation Unit (FSU), a Paraffinic Solvent Recovery Unit (PSRU), a Tailings Solvent Recovery Unit (TSRU), and a Vapour Recovery Unit (VRU). FIGS. 2B-2E and 3B-3E are expanded drawings of the FSU, PSRU, TSRU and VRU, respectively, of FIGS. 2A and 3A.

Figure 3B:
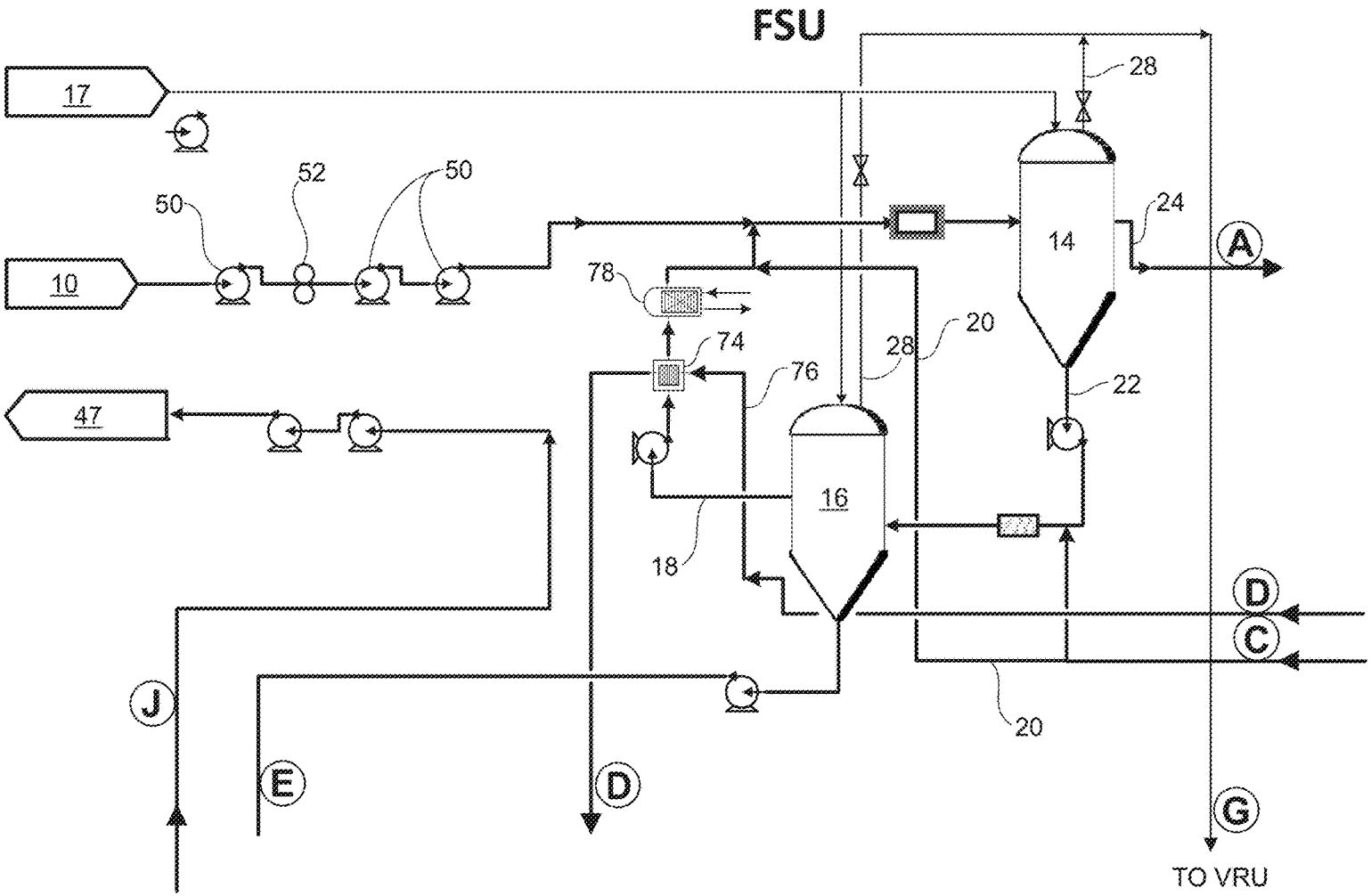

With reference to FIGS. 2B and 3B, relative to embodiments of the FSU, froth 10 produced in an extraction and primary separation stage, is typically stored in a froth tank 12 and is pumped therefrom into the high temperature paraffinic froth treatment (HTPFT) processes described herein. Because HTPFT processes are generally more effective at removal of water and minerals than lower temperature froth treatment, froth 10 used in embodiments taught herein can be lean, having a lower amount of bitumen therein, typically less than 40%, and a higher amount of water and mineral, without materially affecting the facility product quality. HTPFT can be used to treat lean froth 10 having bitumen content between about 31% to about 55% bitumen, typically sourced from flotation froth, cyclonic extraction froth, or mechanical separation froth.

The stream of froth 10 is combined, as taught below, at high temperature with a paraffinic solvent, which in embodiments taught herein is a combination of n-pentane and iso-pentane, with trace amounts of butane, hexane and diesel fraction components, at temperatures in the range of from about 60° C. to about 130° C. and, more particularly, at about 90° C.

In embodiments, as shown in FIG. 1, the FSU is a two stage counter-current solvent extraction system utilizing a first froth separation vessel 14 and a second froth separation vessel 16, as taught in Canadian Patent 2,454,942 and described above. In embodiments, the first and second separation vessels 14,16 are gravity separation units or vessels.

Fresh and/or recycled paraffinic solvent 20 is added either to the second FSU vessel's overflow stream 18 or into the second FSU vessel 16, which receives an underflow stream 22 from the first FSU vessel 14. In embodiments taught herein, the first FSU vessel 14 produces an overflow stream 24, which comprises largely paraffinic solvent and product bitumen. In embodiments, a target, solvent-to-bitumen ratio, for the solvent mixture as described above, in the first separation vessel's overflow stream 24 is about 1.8 by mass. Vapor or gas, produced as an overhead stream 28 from the first and second separation vessels 14,16 is directed to the VRU (Stream G). Should the aromaticity of the solvent mixture increase, such as resulting from the presence of aromatic contaminants, the S:B ratio is adjusted accordingly.

In embodiments, gas 17, such as natural gas NG, nitrogen $N_2$, or other inert gas, is added to the first and second FSU vessels 14, 16, operated at pressures of about 700 KPa(a), to ensure gases below an upper explosive composition limit are not present therein to minimize the risk of fire and/or explosion.

Figure 3C:
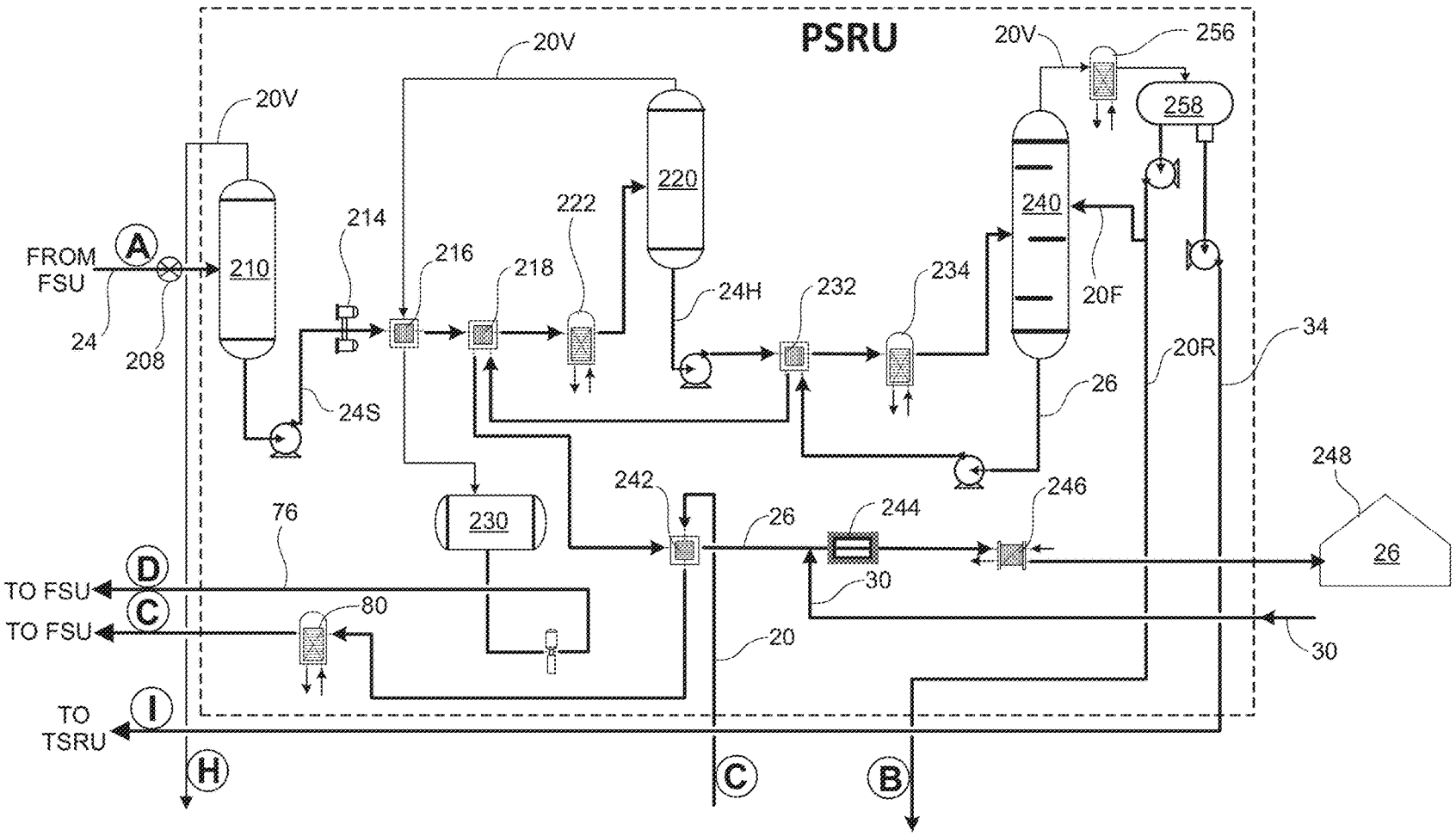

With reference to FIGS. 2C and 3C, relative to embodiments of the PSRU, the first FSU vessel's overflow stream 24, containing largely bitumen and solvent, is delivered to the PSRU (Stream A), which is used to recover the paraffinic solvent 20 from the overflow stream 24. Once the paraffinic solvent 20 is removed, the remaining product bitumen 26 is delivered downstream of the HTPFT for further refining.

In embodiments, the product bitumen 26 is cooled and blended with a stream of naphtha 30 prior to storage and/or transport. Blending with naphtha 30 makes the cooled, stored, blended bitumen product 26 less viscous and easier to handle. In embodiments, the blending is typically done at a dilution of about 5% with naphtha 30. In embodiments, additional naphtha and butane 31 can also be added to the bitumen/naptha stream for downstream delivery.

The paraffinic solvent 20 recovered in the PSRU is delivered to solvent storage 32 (Stream B), whereupon it is typically recycled back into the FSU (Stream C, D). Water 34 recovered in the PSRU (Stream I) is recycled to within the HTPFT, such as to an underflow or tailings stream 36 (Stream E) from the second froth separation vessel 16 (FIGS. 2B and 3B). Vapor produced in the first stage of solvent recovery in the PSRU (Stream H) is delivered to the VRU.

Figure 3D:
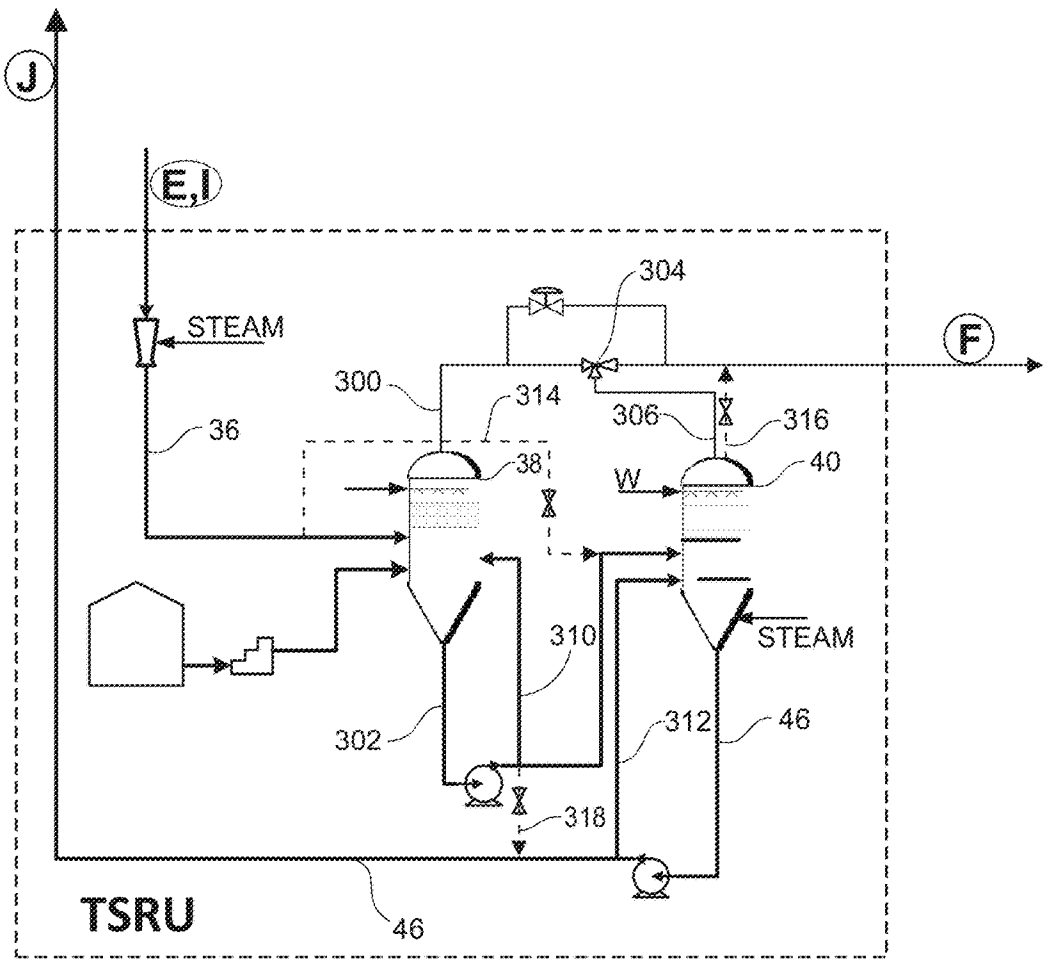

With reference to FIGS. 2D and 3D, relative to embodiments of the TSRU, the underflow or tailings stream 36 from the second froth separation vessel 16 comprises largely minerals/fine solids (less than about 44μ), precipitated asphaltenes, water and residual solvent. The tailings stream 36 is directed to the TSRU (Stream E) for recovery of the residual paraffinic solvent 20 therefrom. In embodiments, the TSRU comprises first and second TSRU vessels 38, 40, operated in series. The tailings stream 36 from the second froth separation vessel 16 is delivered to the first TSRU vessel 38. An underflow 302 from the first TSRU vessel 38 is delivered to the second TSRU vessel 40. A solvent-containing overhead 300,306, produced from the first and second TSRU vessels 38,40, is ultimately processed and the solvent 20 delivered to the solvent storage 32 for recycling in the HTPFT. A solvent-depleted tailings stream 46, produced as an underflow stream from the second TSRU vessel 40, is ultimately sent to disposal 47 (Stream J). Vapor produced by the TSRU is directed to the VRU (Stream F) for solvent recovery.

Figure 3E:
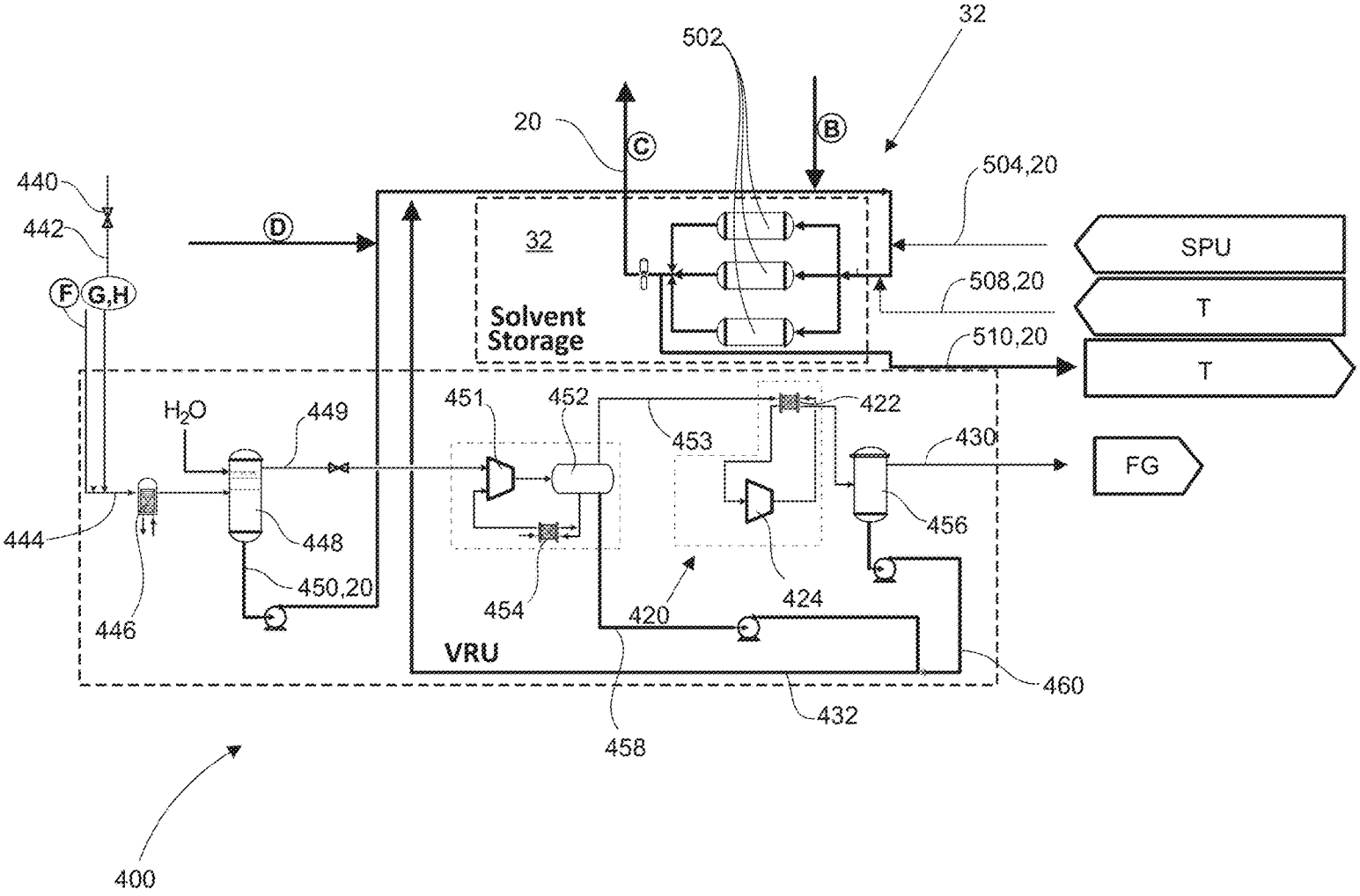

With reference to FIGS. 2E and 3E, relative to embodiments of the VRU, residual solvent vapors produced from the FSU (Stream G), TSRU (Stream F) and PSRU (Stream H) are condensed and delivered to the solvent surge and storage system 32 for recycling to the FSU (Stream C). Residual vapors that are not condensed are generally recycled for use as fuel gas FG in boilers of the HTPFT system.

Having provided a general overview of the HTPFT process, specific embodiments will now be discussed. IN the HTPFT process, froth 10 may be heated before it is delivered to the first FSU 14.

In an embodiment, best seen in FIG. 2B, prior to heating and the addition of paraffinic solvent 20 to the froth 10 to produce a solvent-diluted froth 11, which is being pumped using one or more pumps 50 from a froth source, typically the froth tank 12, the froth 10 is pushed through an inline grinder 52 to positively size solids therein. The solids, which may include environmental materials and contaminants that may have accidentally entered the froth 10, are ground to less than about ⅜". The froth 10 is passed through the inline grinder 52 prior to the addition of the paraffinic solvent 20, rather than after, to simplify seal arrangements and maintenance in downstream apparatus. More particularly, the grinder 52 is located upstream of one or more first heating apparatus 54 used to increase the temperature of the froth 10 to avoid fouling and flow problems therethrough. The one or more first heating apparatus 54, are used to ensure the froth 10 is heated sufficiently to be at the process temperature of between about 60° C. to about 130° C. in the first FSU vessel 14. In embodiments, the process temperature in both the first and second FSU vessels 14,16 is about 90° C.

In an embodiment, the one or more first heating apparatus 54 are used to heat the froth 10 by exchanging heat from the second TSRU underflow tailings stream 46 (Stream J) to the froth 10, prior to the addition of the paraffinic solvent 20. The process of exchanging heat from the tailings stream 46 to the froth 10 can be achieved using different types of heat exchange apparatus 54, including, but not limited to, double pipe heat exchangers, spiral plate exchangers, and heat pumps.

Figure 4:
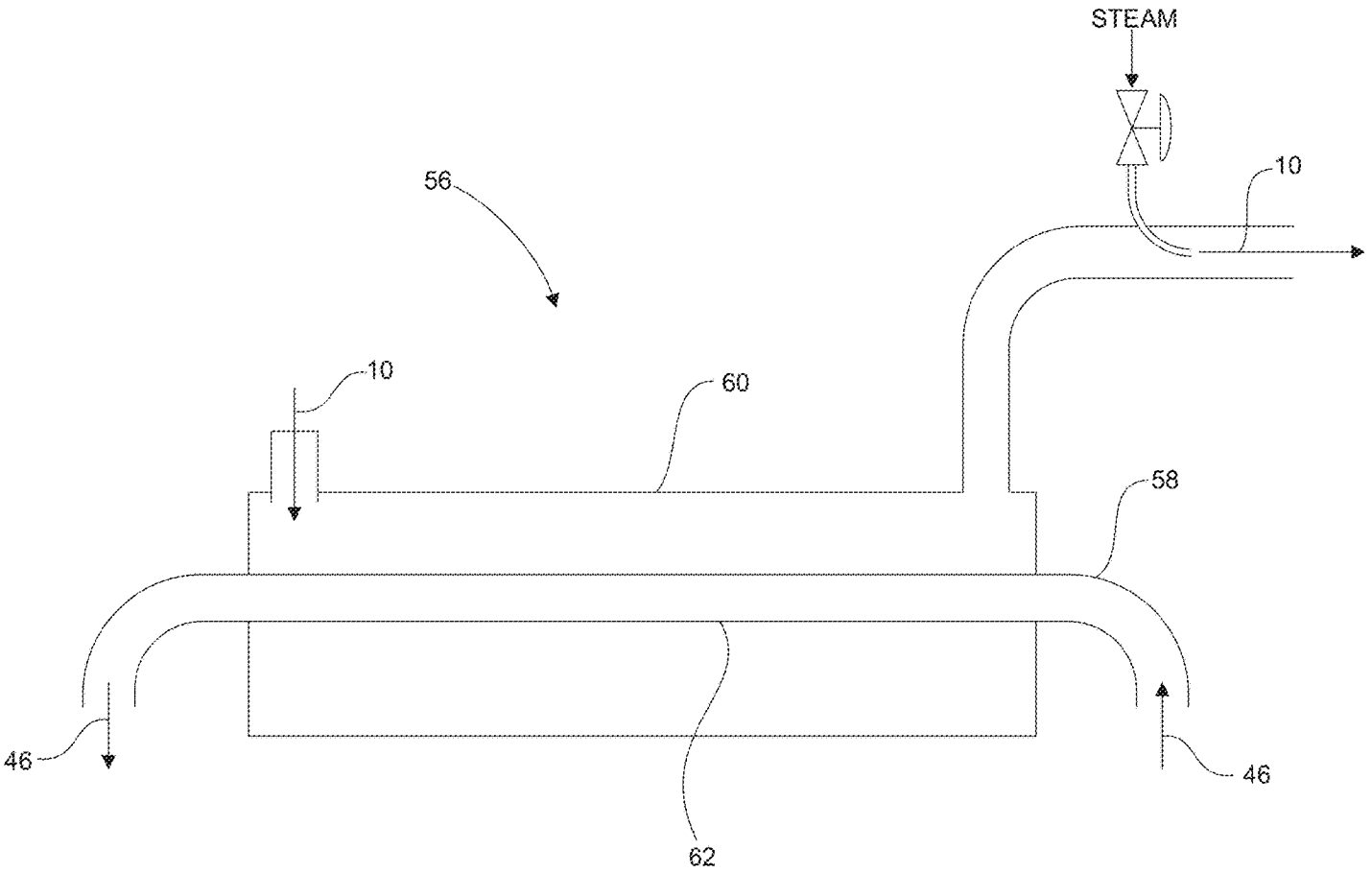
FIG. 4 is a cross sectional view of a conventional double pipe heat exchanger and steam injection for heating froth.

As shown in FIG. 4, in a conventional double pipe heat exchanger 56 the tailings stream 46 is pumped through an inner pipe 58, extending through a larger diameter outer pipe 60, to minimize high wear surface areas therein. Froth 10 is pumped in an opposing direction through the outside pipe 60 and heat is exchanged from the tailings 46 to the froth 10 through a wall 62 of the inner pipe 58. The double pipe heat exchanger 56 may extend from a point at which the froth 10 is first pumped from the froth tank 12 to a point at which the froth 10 is trim heated, such as using steam as described below, prior to the froth 10 entering the FSU.

Alternatively, heat exchange can be done using a spiral plate heat exchanger. In embodiments, to properly match the velocities, gaps and materials, embodiments of a special format of spiral plate heat exchanger are used as described in Applicant's Canadian Patent Application 2,969,595, the entirety of which is incorporated herein by reference.

Both the conventional double pipe heat exchanger 56 and the spiral heat exchanger taught in CA 2,969,595 require further downstream trim heating for proper final froth temperature and control. For this trim heating, two options of a trim heater 64 are conventional. In a first option, the froth 10 is further heated using direct injection steam heating, such as described in the U.S. Pat. No. 8,685,210 to Suncor Energy Inc. or using direct steam injection heating using a sonic injector, such as using a Hydroqual™ unit available from Hydro-Thermal Corp.

Figure 5:
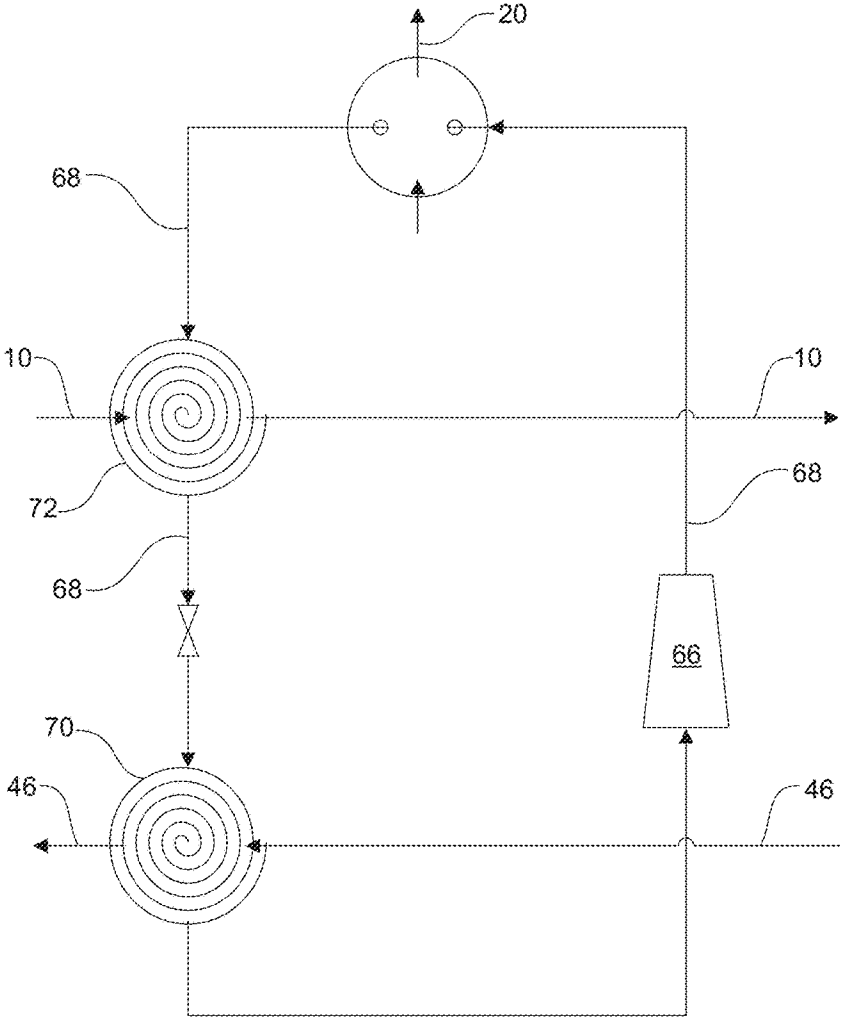
FIG. 5 is a schematic illustrating an embodiment taught herein for heating froth using a heat pump.

As shown in FIG. 5, in an embodiment, as an alternative to challenges in the use of the previously described heat exchanger options, which result from a tight temperature approach, fluids with particulates therein, high viscosity and multiple phases on both sides of the heat exchanger, a heat pump 66 is used to drive heat from the tailings stream 46 into the froth 10. The heat pump 66 utilizes an intermediate fluid 68, such as hexane, cyclohexane, ethyl amine or heptane, as a refrigerant, evaporating against the tailings stream 46, such as in a first spiral plate heat exchanger 70. The intermediate fluid 68 is then compressed to increase the sensible temperature therein and is then condensed against the froth 10, such as in a second spiral plate heat exchanger 72. Use of the heat pump 66 provides some advantages. The intermediate fluid 68 simplifies the exchanger designs as there is only one difficult fluid, being either the tailings stream 46 or the froth 10, in each of the first and second spiral plate heat exchanger 70,72. The heat pump 66 allows for increased use of the heat in the tailings stream 46 by removing temperature pinch constraint. Further, the heat pump 66 can be optimized for capital expenditure on the heat pump 66 and the spiral exchangers 70,72, based on customizing an approach temperature, which is the minimum allowable temperature difference in the temperature profiles for the froth 10 and the tailings stream 46. As one of skill will appreciate, the cost of the heat pump, which is driven by the temperature shift that is generated wherein the higher the temperature difference the higher the cost, is balanced by the savings achieved in the heat exchangers, which are driven by the temperature approach wherein the greater the temperature difference the lower the cost.

Use of the heat pump 66 is advantageous as the heat pump 66 is better able to control the temperature of the froth 10, compared to direct heat exchange. Further, any extra sensible heat, likely to be in the intermediate exchange fluid 68 following heating of the froth 10, can potentially be rejected to the incoming solvent 20 with use of a simple heat exchanger. A further advantage, resulting as a byproduct of removing any additional sensible heat, is the further cooling of the tailings stream 46, ensuring that any remaining volatile material therein is no longer volatile, thereby reducing fire and odour hazards.

As shown in FIG. 3B, in another embodiment, the froth 10 is heated via the addition of the overflow stream 18 from the second FSU vessel 16. The overflow stream 18 is further heated in a heat exchanger 74 using a hot condensate stream 76 produced in the PSRU, as described in greater detail below. Trim heating, using a steam heat exchanger 78, is added to the overflow stream 18 prior to being combined with the froth 10 entering the first FSU vessel 14, as required. Further, additional solvent 20, as required in the first FSU vessel 14 to achieve the first FSU overflow stream's S:B ratio of 1.8, is also heated in a heat exchanger 80 (FIG. 3C) using residual heat generated in the PSRU, as discussed in greater detail below;

FSU

Best seen in FIGS. 2B and 3B, the heated froth 10, is pumped to the FSU such as from the froth tank 12. As previously described with respect to prior art Canadian Patent 2,750,995, the froth separation circuit FSU is a two stage counter-current solvent extraction that uses the incompatibility of the asphaltenes with paraffinic solvents to achieve partial solvent deasphalting of the bitumen, coalescence/settling of the water and agglomeration of the mineral. In embodiments, the first and second stage froth separation units 14, 16 are operated from about 60° C. to about 130° C.

In the embodiments, the FSU circuit is operated at, or about, 90° C. in both a first and second stage FSU vessels 16, 18. Operation is centered on the S:B ratio of about 1.8 by mass in the first FSU vessel's solvent-diluted bitumen overflow stream 24. The S:B ratio can be varied to increase or decrease the amount of asphaltene retained or rejected as appropriate to the feed quality, final bitumen viscosity, flux rate required in the FSU vessels 14, 16 and agglomeration requirements. Such adjustments are made under the guidance of one skilled in the art to accommodate a variety of froth and solvent qualities.

Large scale conventional FSU vessels are hydraulically turbulent, unless filled with partitions which bring down the specific length. In embodiments taught herein, having reference to FIGS. 6A to 14, improvements to the conventional FSU circuit taught herein are generally related to modifications to the feed apparatus, to the separation vessel design or both.

In an embodiment, having reference to FIGS. 6A to 6D, the FSU vessels 14, 16 are designed to have a separation zone 82 within the FSU vessel 14,16 of about 1.2 times the vessel diameter in height. The increased vertical height accommodates the turbulence and minimizes or prevents single eddy short circuiting therein, which would otherwise decrease effective gravity separation. A height 87 of a semispherical volume 81 at a top 83 of the vessel 14, 16 is about 0.5 times the diameter of the vessel 14,16.

In a further embodiment, also shown in FIGS. 6A-6D, a feed nozzle arrangement 84 acts to further minimize disturbance within the FSU vessels 14, 16. The nozzle arrangement 84 comprises six nozzles 86, positioned in the FSU vessel 14,16 adjacent a transition 88 from a conical bottom portion 90 therein to an upper cylindrical portion 92. In an embodiment, the nozzles 86 are fluidly connected to a vertically extending inlet pipe 94, such as by downwardly and radially outwardly extending feed pipes 96, which symmetrically locate the nozzles 86 about a circumference of the FSU vessels 14, 16 and adjacent an outer wall 98 thereof. In an embodiment, the feed pipes are angled downwardly at about 135° relative to the inlet pipe 94. In an embodiment having the six nozzles 86, the nozzles 86 are arranged in three groups, each group having two opposing nozzles 86, angled so as to create a flow of solvent-diluted froth 11 therefrom that opposes the flow of solvent-diluted froth 11 from an adjacent nozzle 86 in an adjacent group of the other two groups of opposing nozzles 86. All of the nozzles 86 deliver the solvent-diluted froth 11 in the same horizontal entry plane. In an embodiment each of the groups of nozzles 86 are spaced circumferentially at about 120° apart. The nozzles 86 are sized to a low Richardson number, to help fully spread the solvent-diluted froth 11 through the horizontal entry plane. In embodiments, the opposing direction of the nozzles 86 acts to cancel or minimize the momentum and maximize energy dispersion in the incoming solvent-diluted froth 11, reducing large eddies within the FSU vessels 14,16, as the feed is not directed at the walls of the vessel 14,16. Alternatively, a feed nozzle arrangement, such as taught in Canadian Patent application 2,867,446 to Total E&P Canada Ltd., can be used.

A conventional FSU vessel typically comprises a launder for collection of solvent/bitumen-containing fluids, which have separated therein and have floated to a top of the FSU vessel. Launders require violent flow to remain clear of buildup and therefore are only suitable where there is sufficient violent action within the FSU vessel to ensure there is no standing liquid level on the launders side of a launder lip.

Figure 6A:
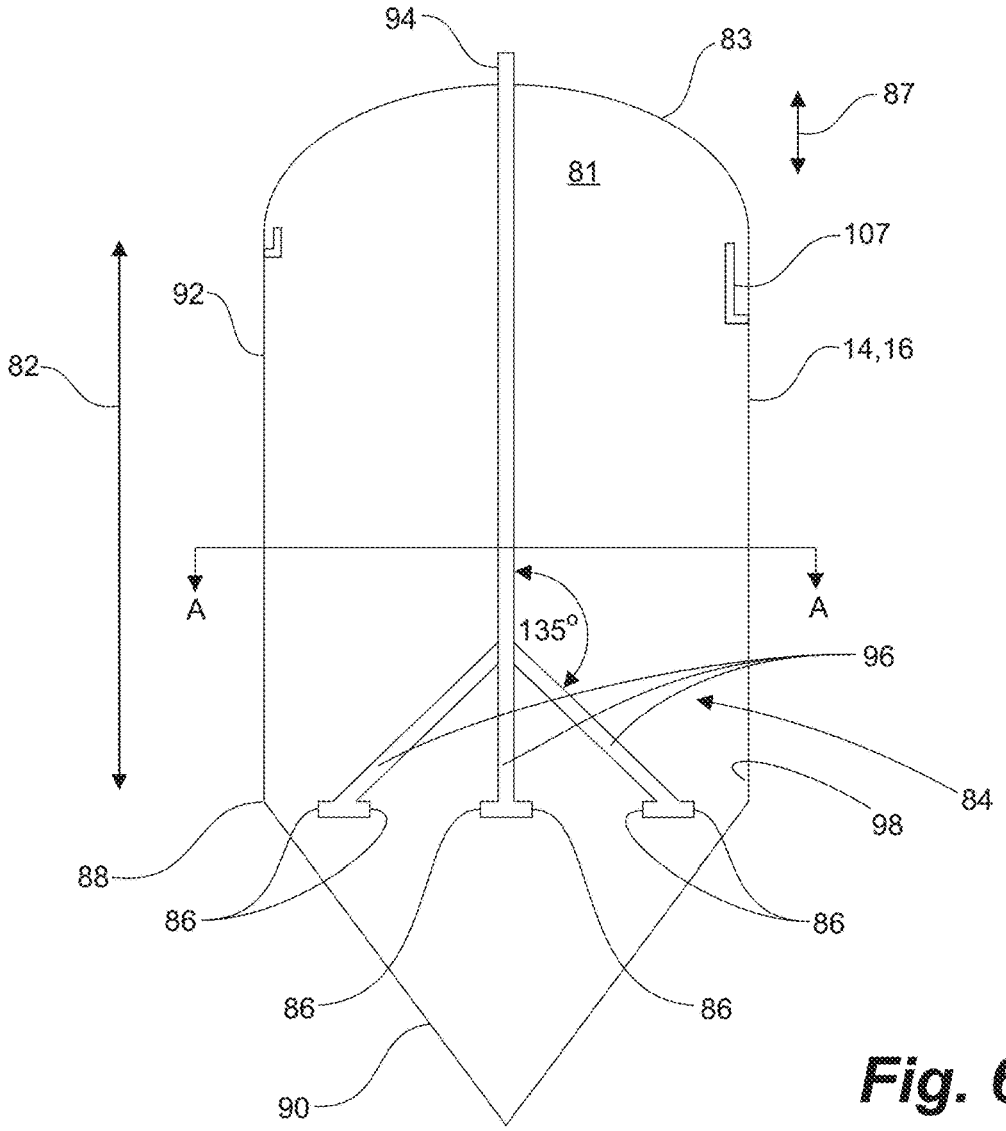
FIG. 6A is cross-sectional view of a froth separation vessel according to an embodiment taught herein having a separation zone of 1.2 times the vessel diameter in height and a feed nozzle arrangement therein.
Figure 6B:
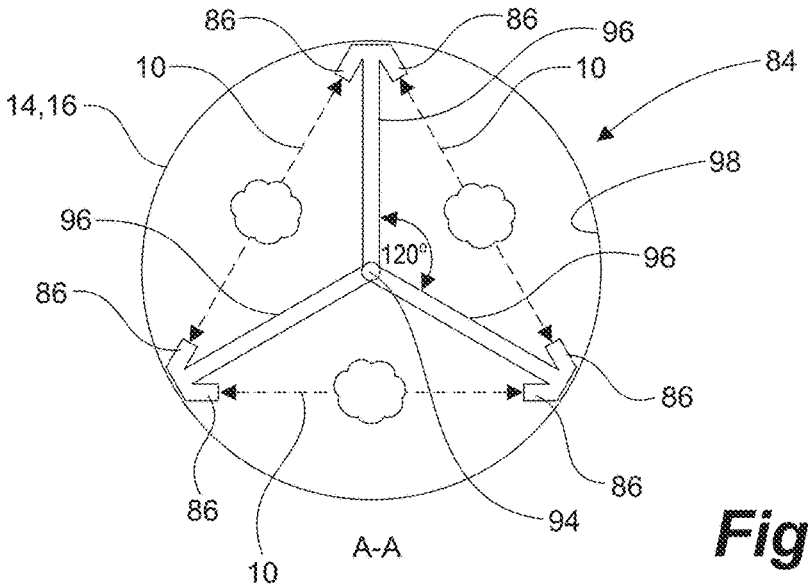
FIG. 6B is a cross-section view along section lines A-A according to FIG. 6A illustrating the feed nozzle arrangement and, in particular, opposing nozzles and flow therefrom acting to minimize disturbance in the feed introduced to the vessel.
Figure 6C:
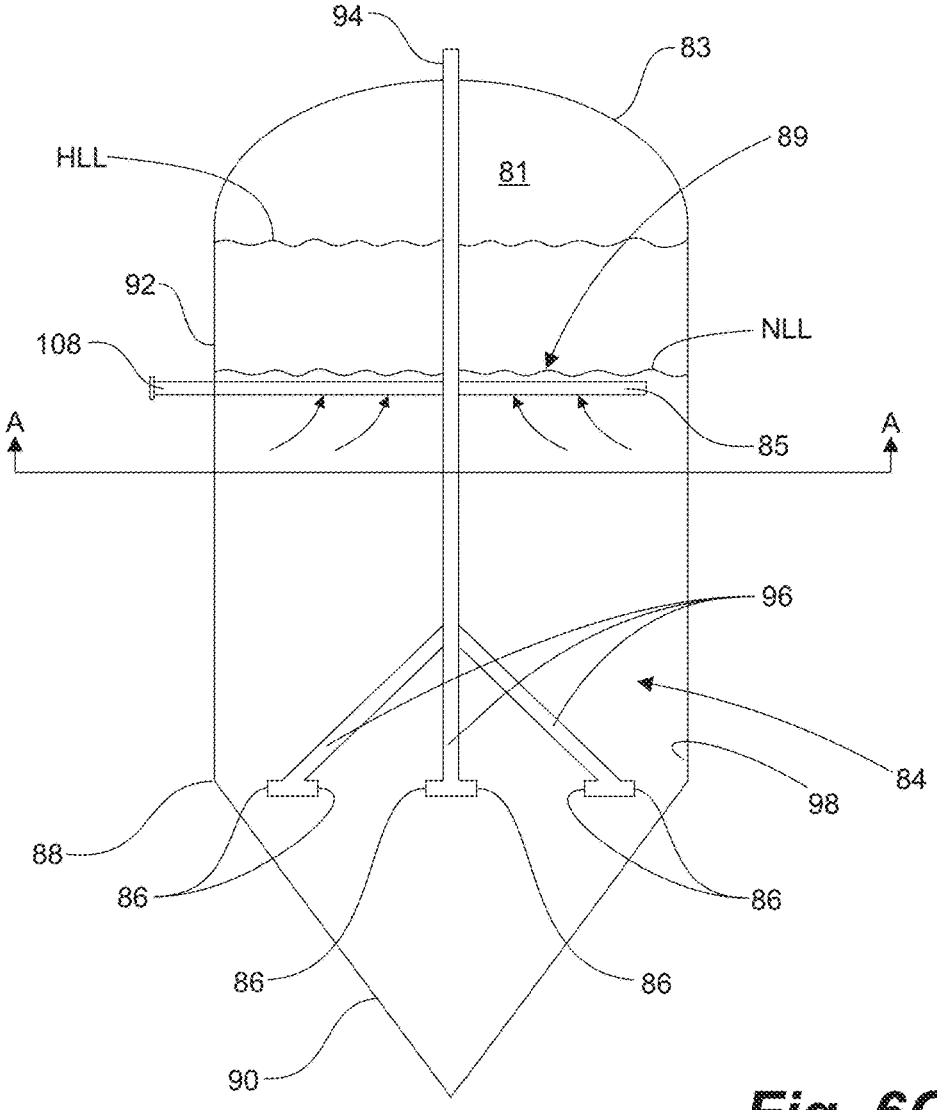
FIG. 6C is a cross-sectional view of the froth separation vessel according to FIG. 6A and having a collector ring located therein for collecting and discharging a solvent/bitumen containing stream therefrom.
Figure 6D:
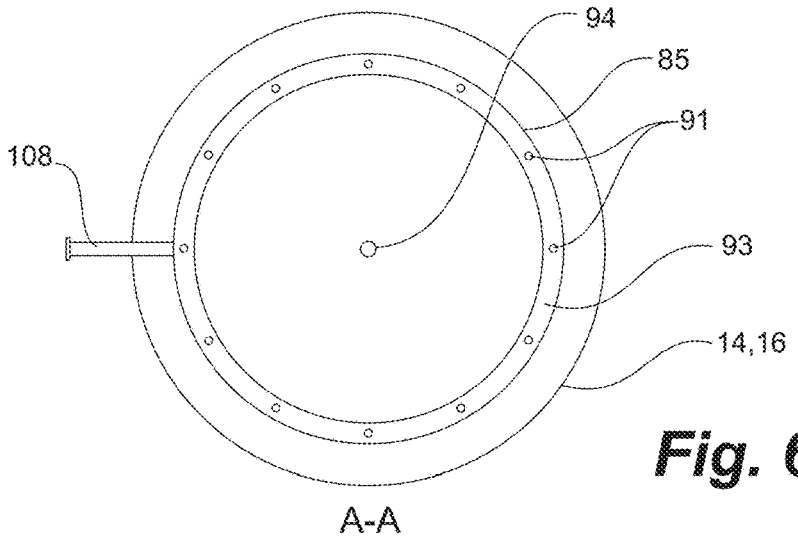
FIG. 6D is a cross-sectional view of a bottom surface of the collector ring of FIG. 6C, sectioned along lines A-A.

Having reference to FIGS. 6C and 6D, in use the FSU vessels of FIGS. 6A and 6B, further comprise a collector ring 85. Best seen in FIG. 6D, the collector ring 85 is a toroidally-mounted pipe having a plurality of inlet apertures 91 distributed at regular intervals along a bottom surface 93 thereof. The collector ring 85 acts to collect the solvent-diluted bitumen, forming overflow streams 18,24, as evenly as possible from a plane at a top 89 of the separation zone 82 for discharge from a discharge conduit 108, fluidly connected thereto.

Figure 7:
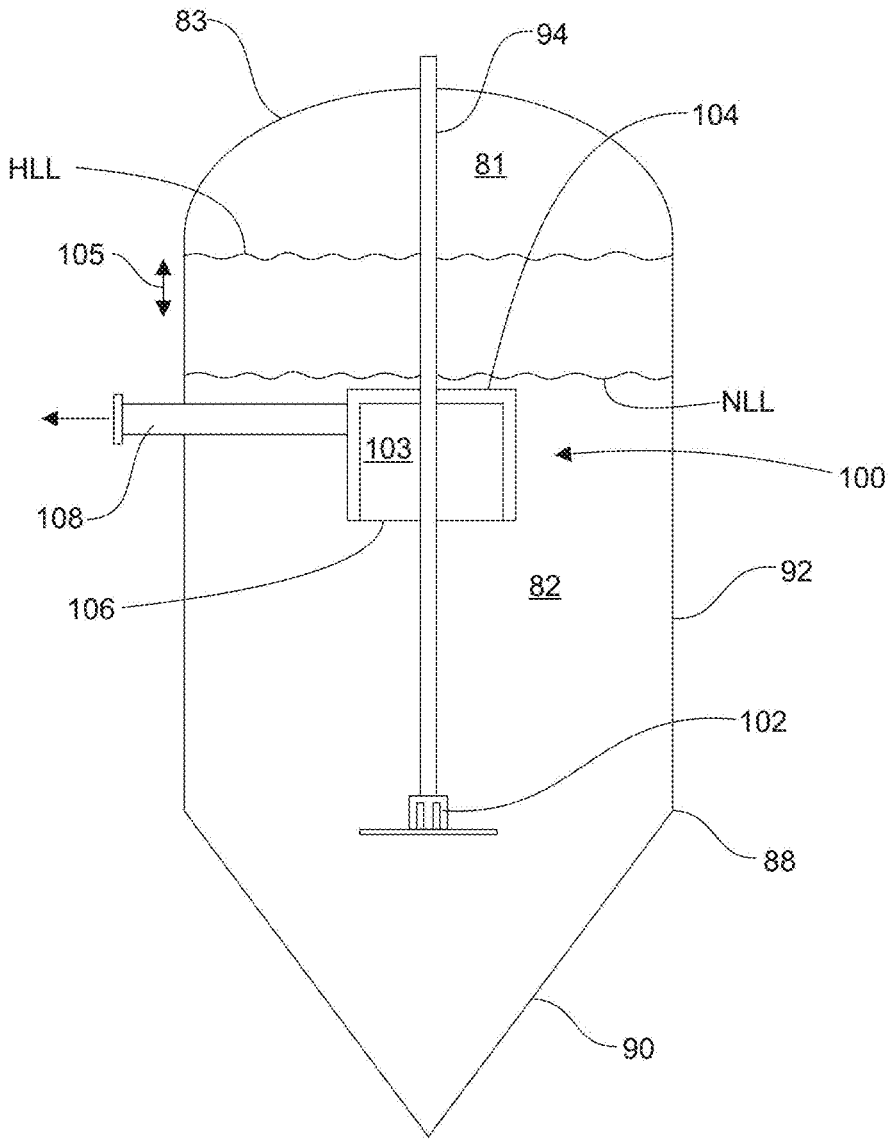
FIG. 7 is a cross-sectional view of a froth separation vessel having a conventional feedwell and a collector pot located therein for collecting and discharging a solvent/bitumen-containing stream therefrom.

In a further embodiment, as shown in FIG. 7, a collector pot 100 is suspended within the separation zone 82 in the cylindrical portion 92, above a conventional feedwell 102, such as used by Albian Sands Energy Inc. in the Athabasca Oil Sands Projects in Northern Alberta, Canada. In embodiments, the collector pot 100 is suspended about the inlet pipe 94. The feedwell 102, fluidly connected to the inlet pipe 94, is located at about the transition 88. The collector pot 100 comprises a cylindrical collection chamber 103 having a closed top 104, an open bottom 106 and the discharge conduit 108 fluidly connected from the collection chamber 103 to discharge outside the FSU vessel 14,16. Means for liquid level control, such as a level instrument and a valve, maintain a normal operating liquid level NLL within the FSU vessel 14,16 at or above the top 104 of the collector pot 100. Sufficient height of the cylindrical portion 92 allows for a high liquid level HLL or surge volume 105 thereabove. Such an arrangement eliminates the conventional launder and the need for an additional overflow surge vessel.

Figure 8B:
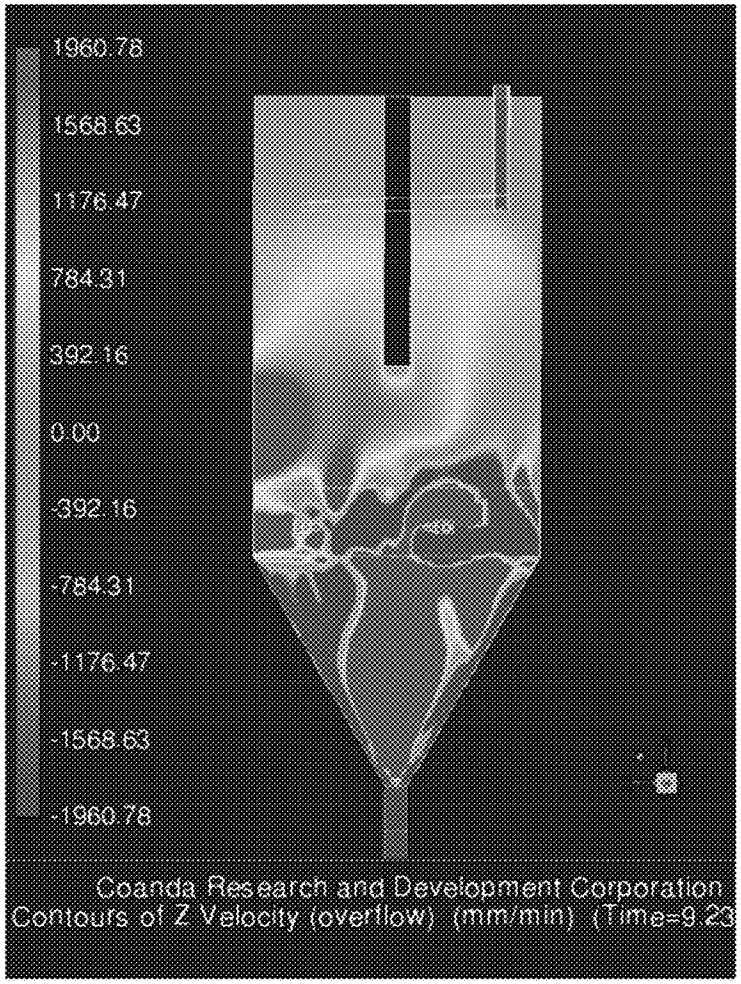
FIGS. 8A and 8B are computational fluid dynamic (CFD) simulations of froth feed flow in a vessel having the feed nozzle arrangement and collector ring as shown in FIG. 6C.
Figure 8A:
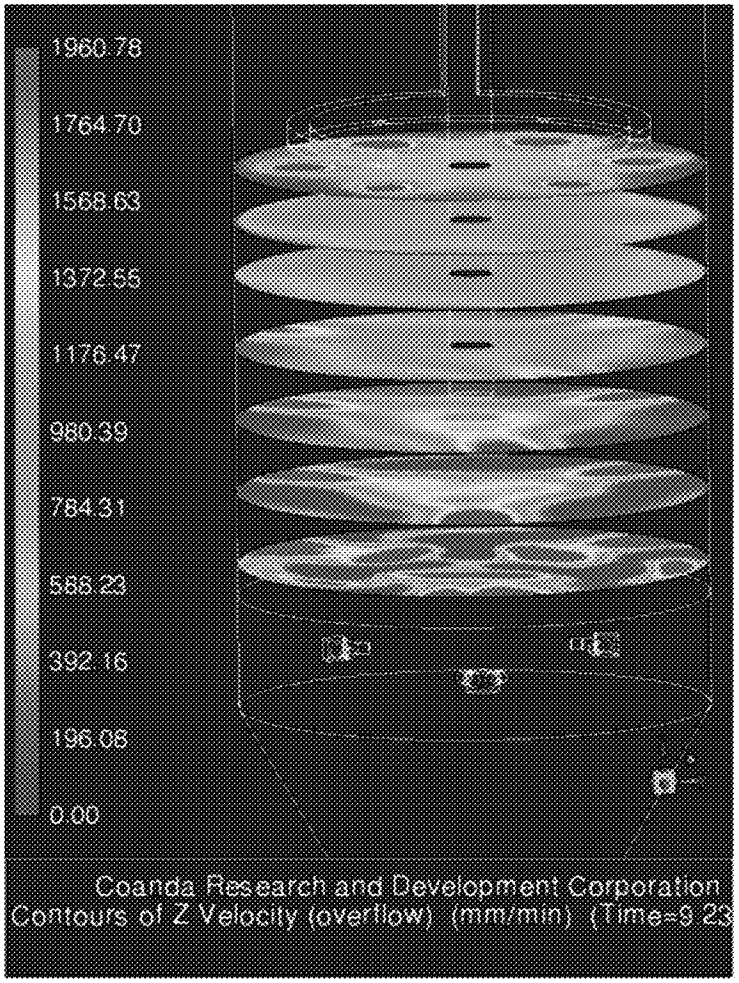

FIGS. 8A and 8B are computational fluid dynamic simulations (CFD) of the nozzle arrangement 84 of FIGS. 6A and 6B, in combination with the collector ring 85 as shown in FIG. 6C.

Figure 9B:
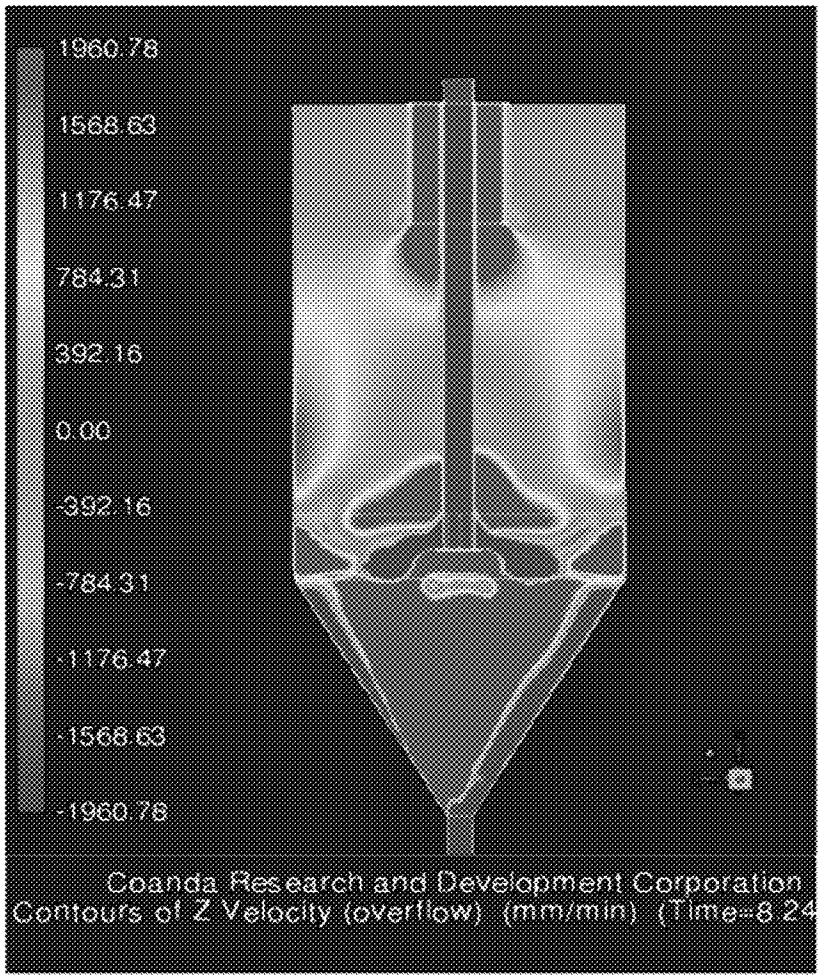
FIGS. 9A and 9B are computational fluid dynamic (CFD) simulations of froth feed flow in a vessel having the conventional feed arrangement and collector pot as shown in FIG. 7.
Figure 9A:
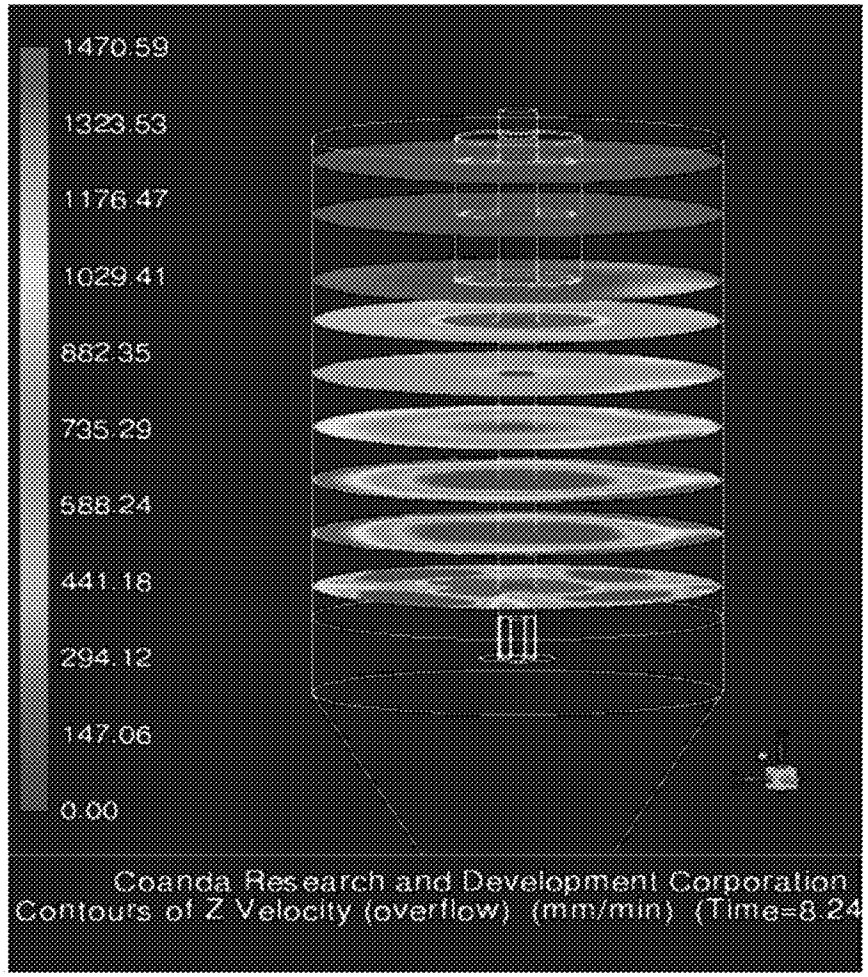

FIGS. 9A and 9B are computational fluid dynamics simulations (CFD) of the collector pot 100 and feedwell 102 arrangement of FIG. 7. The conventional feedwell 102 produces a low disturbance in the vessel 14,16, however high velocities remain at the wall. By collecting the solvent-diluted bitumen, forming overflow streams 18,24, in the collector pot 100 near a center of the vessel 14,16, the fluid rising along the wall must move horizontally before exiting, dramatically reducing upward velocity.

Applicant believes that while both embodiments of feed delivery discussed above show a similar performance, the nozzle arrangement 84 and collector ring 85 embodiment of FIG. 6C is more efficient, while the collector pot 100 and conventional feedwell 102 arrangement of FIG. 7 is more robust.

Figure 10:
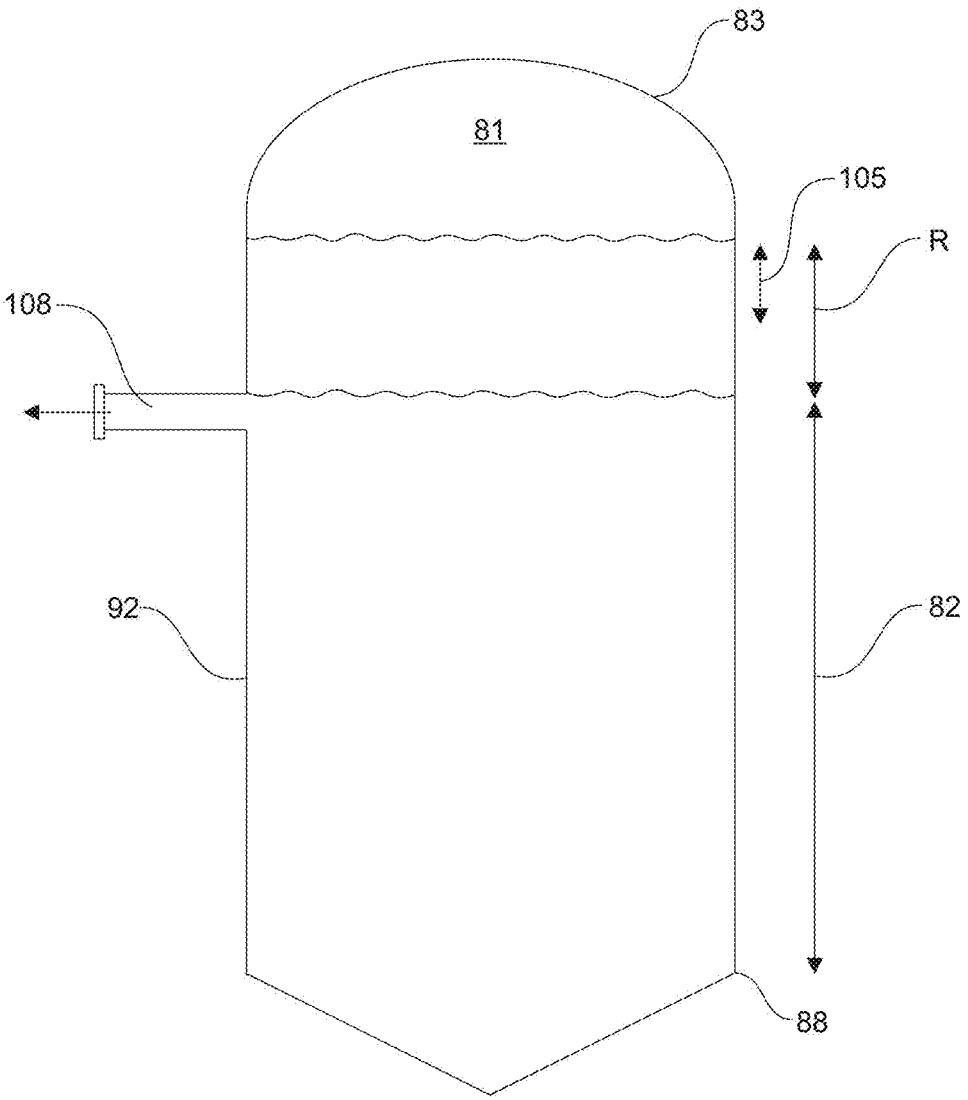
FIG. 10 is a cross-sectional view of a froth separation vessel having extra volume above an overflow collector located therein.

Having reference to FIG. 10, in another embodiment a further alternative to the conventional FSU vessel is a separation vessel 14,16 comprising an additional retention volume R above an overflow collector, such as a collector pot 100 as shown in FIG. 7 or a collector ring 85 as shown in FIG. 6C allowing for control of the flow from the separation vessel 14,16 to downstream equipment. Further, the additional retention volume R accommodates a surge volume 105 therein thereby eliminating the need for a separate surge vessel and without impacting the height of the separation zone 82 in the vessel 14,16. Use of the retention volume R in the FSU vessels is particularly valuable for smaller treatment plants where the FSU vessels 14,16 can be shop fabricated.

Figure 11:
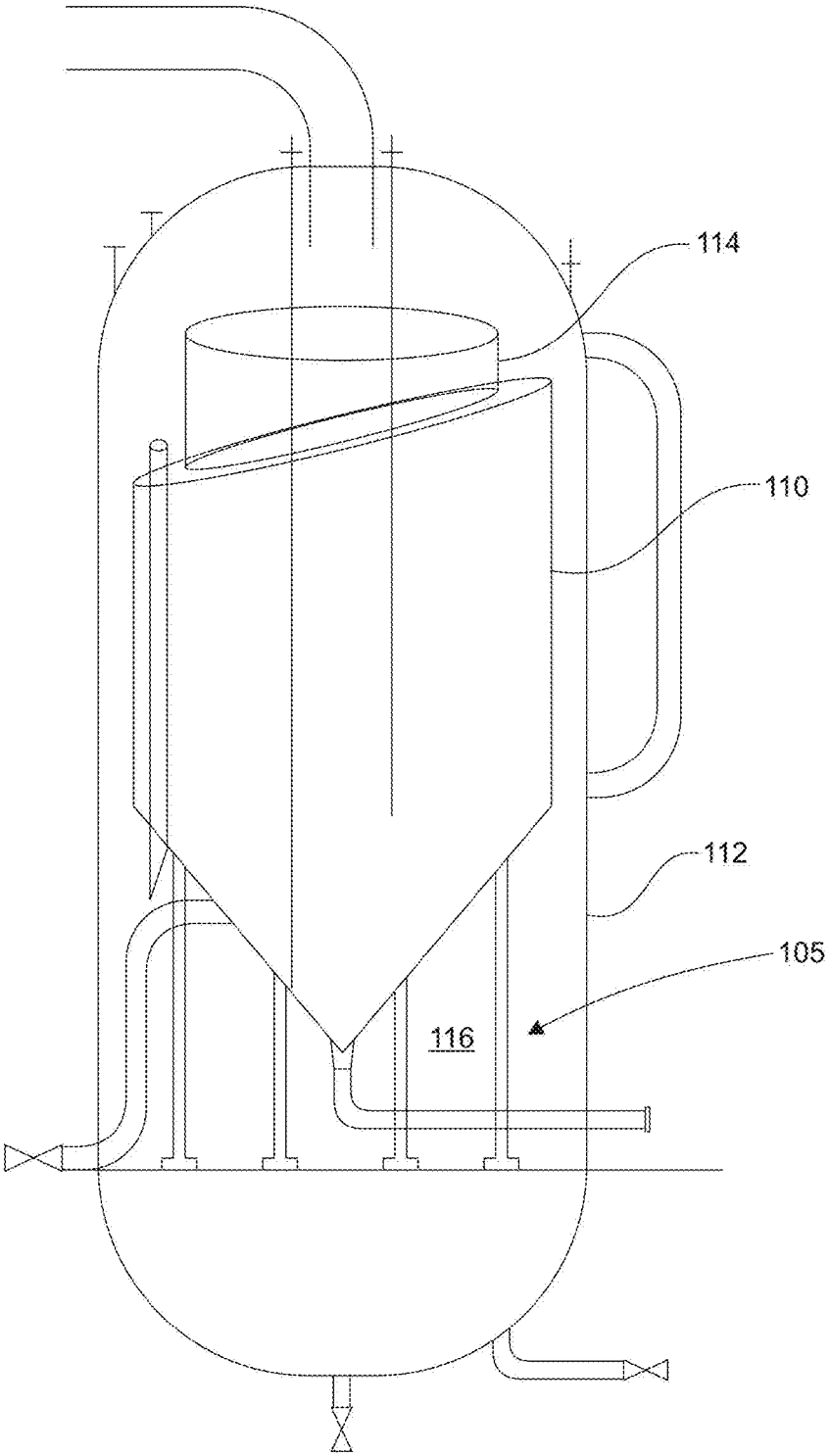
FIG. 11 is a cross-sectional view of a froth separation vessel comprising segregated wear and pressure envelopes therein.
Figure 12:
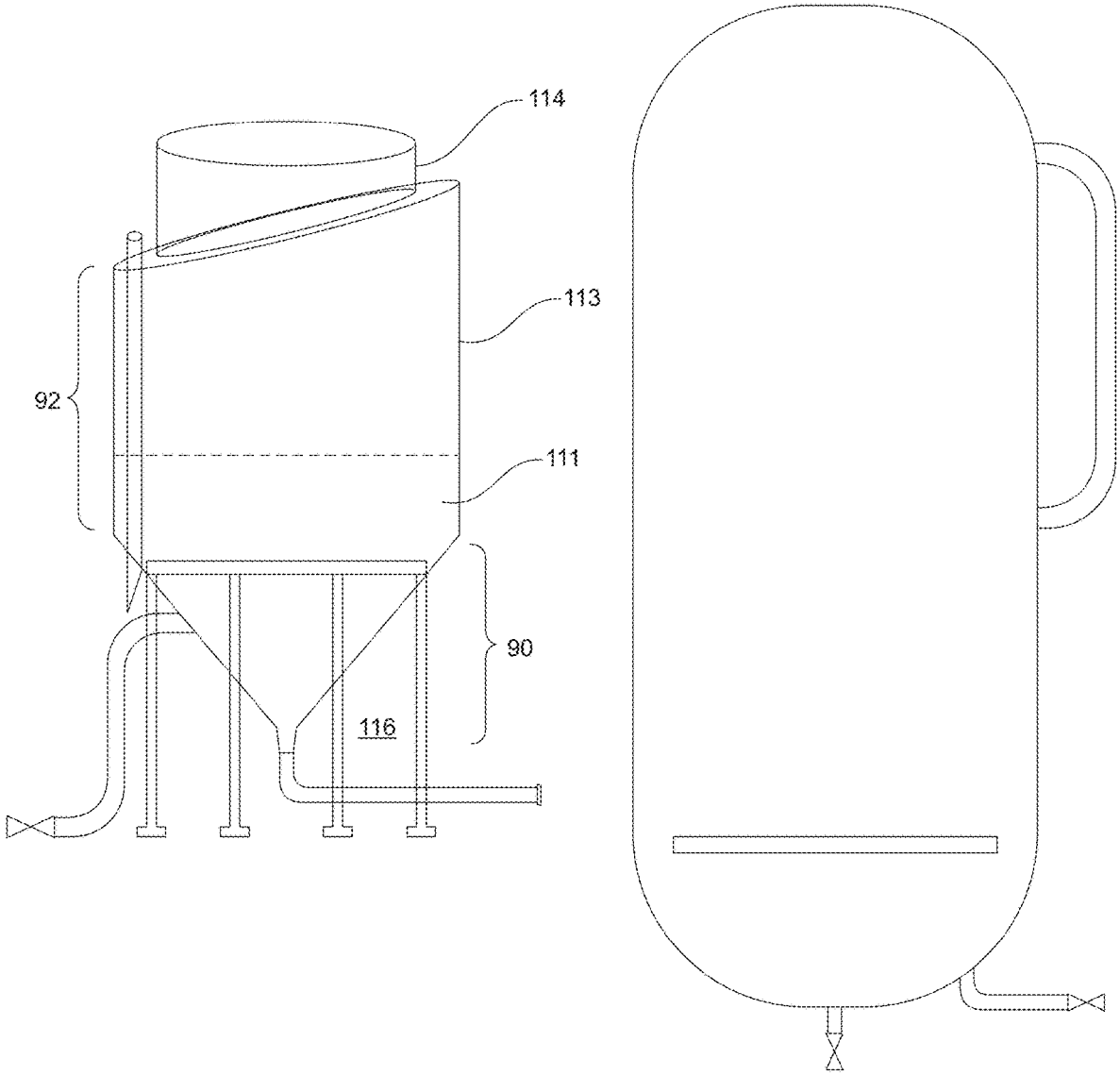
FIG. 12 is a cross sectional view of each of the wear envelope and the pressure envelope according to FIG. 11.

As shown in FIGS. 11 and 12, in yet another embodiment of the vessel 14,16, the FSU vessel 14,16 comprises a segregated wear envelope 110 and pressure envelope 112. The vessel 14,16 provides an equivalent surge volume 105 to that of a vessel having integrated wear and pressure envelopes 110,112. The segregation is achieved by mounting the wear envelope 110, which is non-pressure retaining, and a liquid or hydraulic envelope 114, inside a conventional pressure bullet or envelope 112. This embodiment has the advantage of easily allowing different materials to be used for the wear and pressure management surfaces, reducing the need to include wear thickness in the pressure envelope 112, and reducing the likelihood of an atmospheric release due to wear failure. In the embodiment as shown, should a wear failure occur despite use of the wear envelope 110, material would be released to within the segregated pressure envelope 112, where it is contained. The space 116 below the wear envelope 110 provides the surge volume 105.

As shown in FIG. 12, the wear envelope 110 may comprise a thicker wear material 111 at the conical bottom portion 90 of the vessel 14,16 and a thinner barrier material 113 thereabove in the cylindrical portion 92 of the vessel 14,16 for containing the hydraulic envelope 114 therein.

A person skilled in the art can select an appropriate design or mixture of designs from the above described improvements to the separation vessels 14,16 to suit the operational, capital, maintenance and other considerations as these aspects are unique to each feed material, operator and project.

Figure 13:
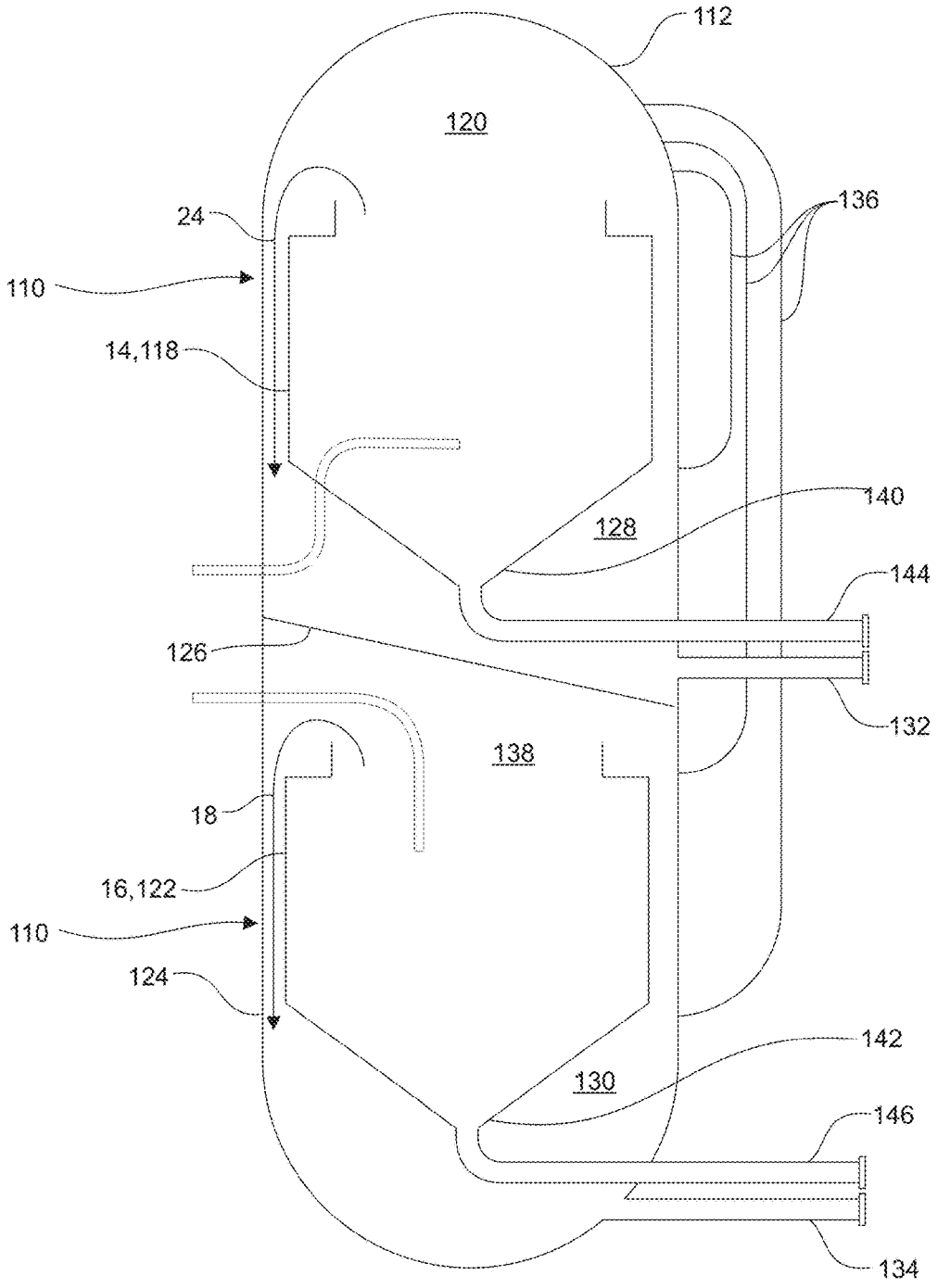
FIG. 13 is a cross-sectional view of a two stage FSU vessel comprising first and second stages within a single footprint, or a paired set of FSU vessels having double area within a smaller diameter pressure vessel.

In a further option, as shown in FIG. 13, multiple wear envelopes 110, in vertical series, can be used to either increase the equivalent cross-sectional area of the froth separation vessel 14,16 or can be used to combine the two stages of separation vessels 14,16 into a single pressure envelope 112.

In the embodiment shown, the first stage FSU vessel 14 formed by a first wear envelope 118 is located in a top portion 120 of the pressure envelope 112, while the second stage FSU vessel 16, formed by a second wear envelope 122 is located in a bottom portion 124 of the pressure envelope 112. The pressure envelope 112 further comprises a divider 126 between the first and second wear envelopes 118, 122 forming an upper storage zone 128 for the solvent-diluted bitumen overflow stream 24 from the first FSU vessel 14 and a lower storage zone 130 for the solvent-diluted bitumen overflow stream 18 from the second FSU vessel 16. The overflow streams 24, 18 are delivered from the storage zones 128,130 through upper and lower outlets 132,134. Pressure equalization lines 136 are provided between each storage zone 128, 130 and the top portion 120 of the pressure envelope 112 as well as between a space 138 below the divider 126 and the top portion of the pressure envelope 112. Tailings are released from a bottom 140,142 of each wear envelope 118, 122 through tailings outlets 144,146.

To operate in a counter-current manner, the overflow stream 18 from the second vessel 16 is fed to the first vessel 14 and the overflow stream 24 is fed to the PSRU, as previously discussed. The tailings are also discharged to the TSRU for solvent recovery as discussed below.

Figure 14:
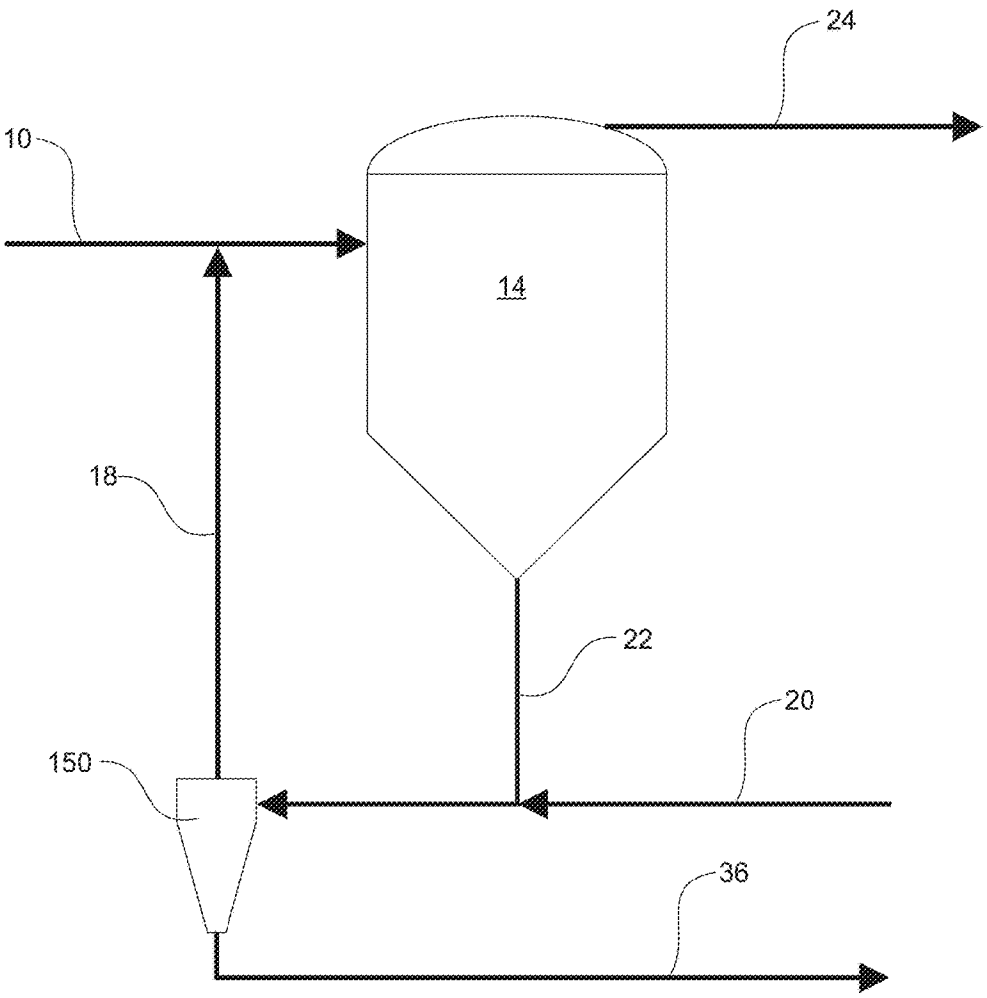
FIG. 14 is a schematic of an embodiment taught herein having one or more hydrocyclones or a cyclopack as the second stage of the froth treatment circuit.

In an embodiment, as shown in FIG. 14, the froth separation vessels 14, 16 comprise the first FSU vessel and one or more hydrocyclones 150 for the second stage of separation. Substitution of the one or more hydrocyclones 150 for the second FSU vessel 16 can be effectively used to great benefit in the case of the second stage of separation. The second stage is primarily tasked with scavenging maltene, which is the non-asphaltene fraction of bitumen, remaining in the gangue material after the first stage of separation and does not produce a final product. Therefore, the sensitivity is skewed to recovery rather than quality of product. Hydrocyclones can be very effective in this service as there is a g-force advantage in gaining recovery, such as compression of agglomerate pore space. In embodiments incorporating one or more second stage hydrocyclones 150, any segregation challenges encountered using the one or more hydrocyclones 150 are mitigated by interface-controlled separation in the first stage FSU vessel 14.

The one or more hydrocyclones 150 may comprise two or more hydrocyclones 150, typically grouped symmetrically in a cyclopack, having an integrated overflow and underflow.

In embodiments, an infrared (IR) analyzer 152 is used to aid in solvent management by assessing the quality of the solvent 20 being blended with the fresh froth 10 so that the dosage of the solvent 20 can be adjusted accordingly, by one skilled in the art familiar with the corrections required to the dosage based on solvent aromaticity, average molecular weight, water content and the like.

Figure 15:
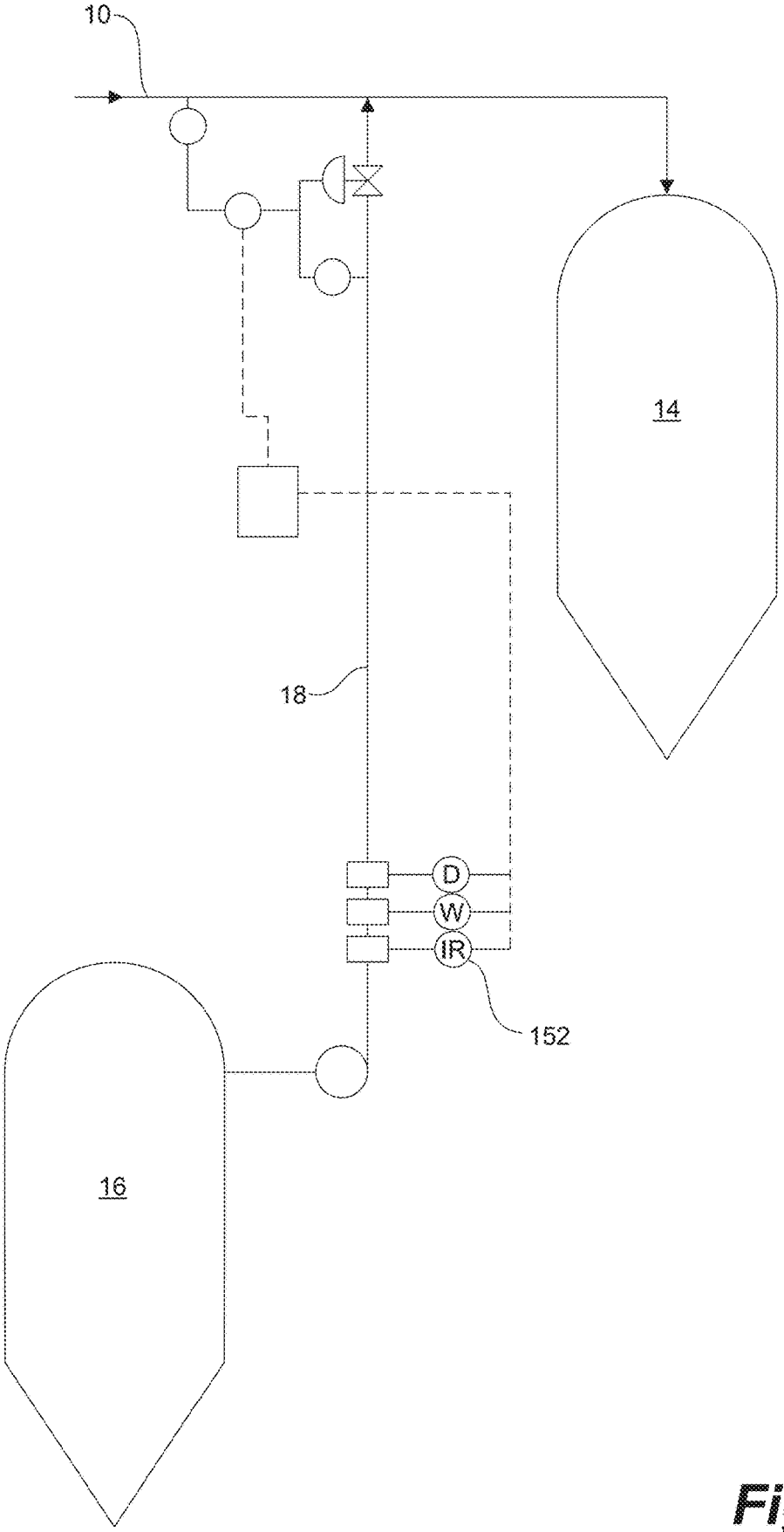
FIG. 15 is a schematic illustrating an embodiment having an IR analyzer and other conventional measurements for monitoring the overhead stream from the second stage FSU to the first FSU.

In embodiments, as shown in FIG. 15, the IR analyzer 152 scans the second FSU vessel's overflow stream 18, referred to in this context as intermediate solvent, as the overflow stream 18 is pumped between the second FSU vessel 16 and the first FSU vessel 16. IR analysis of the intermediate solvent 18 is used, together with other online analysis, such as density (D) and water content (W), to adjust the S:B ratio entering the first FSU vessel 14 so as to achieve the S:B ratio at about 1.8 in the first vessel's solvent-diluted bitumen overflow stream 24 and consistent product quality.

The overhead stream 24 from the first froth separation vessel 14, containing largely the solvent 20 and product bitumen 26, is fed to the PSRU (Stream A).

PSRU

With reference to FIGS. 2C and 3C, the first separation vessel's overflow stream or partially de-asphalted, solvent-diluted bitumen 24 (Stream A) is fed from the FSU into the PSRU. As shown in FIGS. 2C and 3C, the first stage of solvent recovery of the PSRU incorporates a flash valve 208 and an unheated flash vessel 210. In embodiments, the solvent-diluted bitumen 24, being at about 90° C. and having an S:B ratio of about 1.8, is at an asphaltene saturation point as it enters the PSRU. The solvent-diluted bitumen 24 passes through flash valve 208 and exits to the unheated flash vessel 210, which has a pressure lower than the solvent-diluted bitumen 24, causing the solvent-diluted bitumen 24 to flash without the addition of heat.

Figure 16:
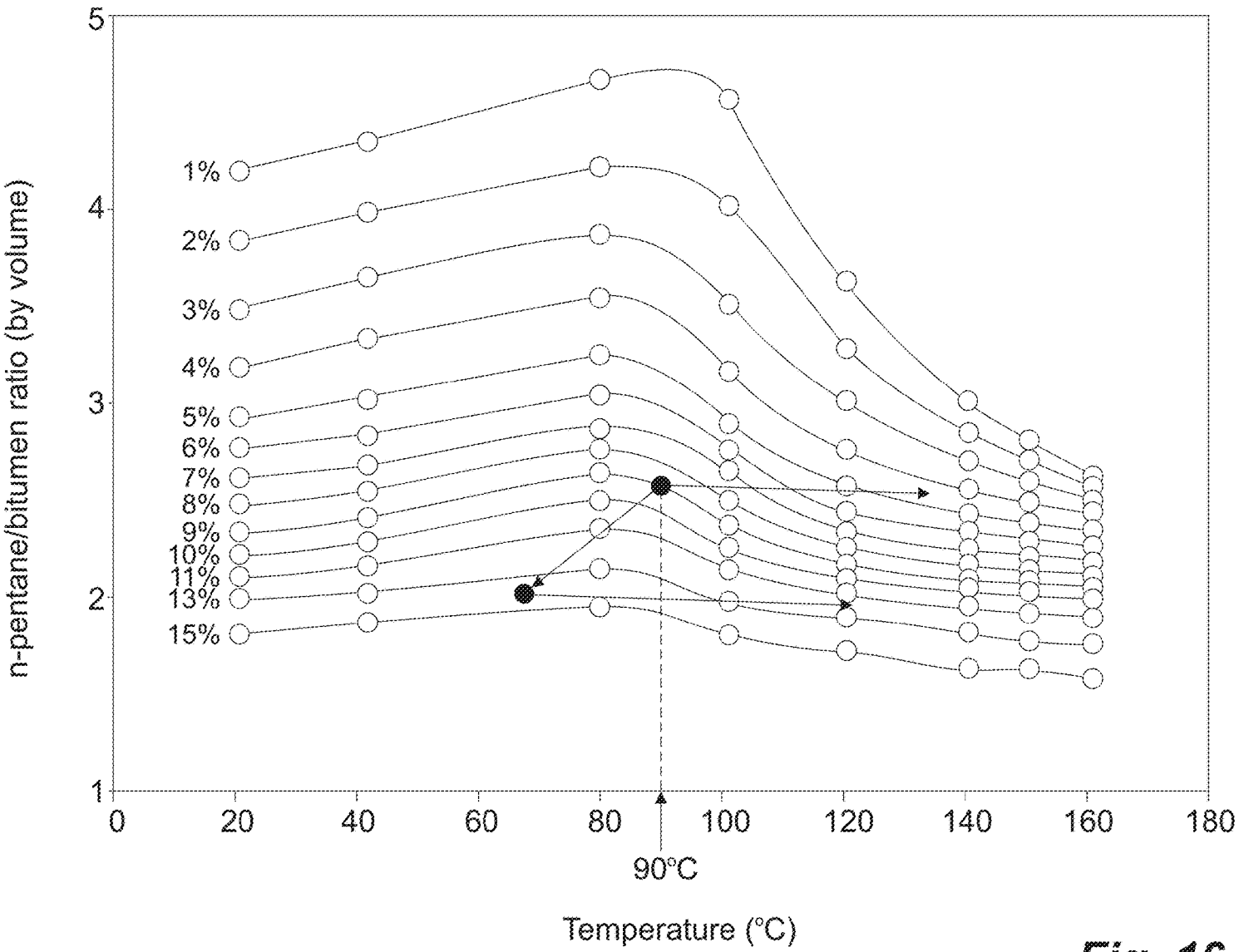
FIG. 16 is a compatibility diagram illustrating the effect of temperature on asphaltene solubility in various n-pentane-to-bitumen ratios by volume.

Having reference to FIG. 16, by allowing the solvent-diluted bitumen 24 to flash without heating, the solvent recovery process is improved as the removal of at least a portion of the solvent moves the solubility parameters away from the compatibility limit thereby minimizing continued asphaltene precipitation and fouling of the solvent recovery apparatus in subsequent stages. In other words, flashing the solvent-diluted bitumen without actively increasing the temperature allows at least some of the solvent 20 to separate so that the change in S:B ratio does not promote further asphaltene precipitation in the subsequent heated stages. The temperature of the outgoing liquid 24S is also reduced sufficiently so that the underflow from the unheated flash vessel 210 can act as a fluid for condensing the overhead vapours from a subsequent, second stage heated flash, which will be described in more detail hereinbelow. Embodiments of the PSRU as taught herein allow for a significant heat integration and economy of energy.

Approximately 25-30% of the solvent 20 is removed from the solvent-diluted bitumen stream 24 in the first stage of flashing. In embodiments, as shown for example in FIG. 2C, the PSRU includes an overhead separator 212 to separate the net solvent vapour 20V from the condensed solvent 20. The separated net vapour 20V is fed to the VRU (Stream H) while the condensed solvent 20 is sent to the solvent storage 32 (Stream B).

In other embodiments, as shown for example in FIG. 3C, the overhead solvent vapour 20V from the unheated flash vessel 210 passes through a Joule-Thomson valve 440 in the VRU (FIG. 3E) for cooling (Stream H).

The second stage of the solvent recovery unit is the heated flash. With further reference to FIGS. 2C and 3C, an underflow stream 24S from the unheated flash vessel 210, which comprises the remaining solvent-diluted bitumen 24, exits the unheated flash vessel 210 and is heated prior to entering a heated flash column 220. The heating is accomplished by condensing an overhead solvent vapour stream 20V from the heated flash column 220 against the unheated flash underflow 24S via a heat exchange apparatus 216, followed by heat integration with the underflow product bitumen stream 26 from a subsequent, downstream steam stripping column 240 via a heat exchange apparatus 218.

In some embodiments, as shown for example in FIG. 3C, the unheated flash underflow 24S may be strained by a strainer 214 before being heated and may be steam trimmed to a desired temperature by a trim heater 222 prior to entering the heated flash column 220. In some embodiments, the feed (i.e. the unheated flash underflow 24S) entering column 220 is at about 172° C. and about 1200 kPaa. The second stage heated flash column 220 flashes an additional about 60-67% of the original solvent 20 from the feed 24S.

Figure 17:
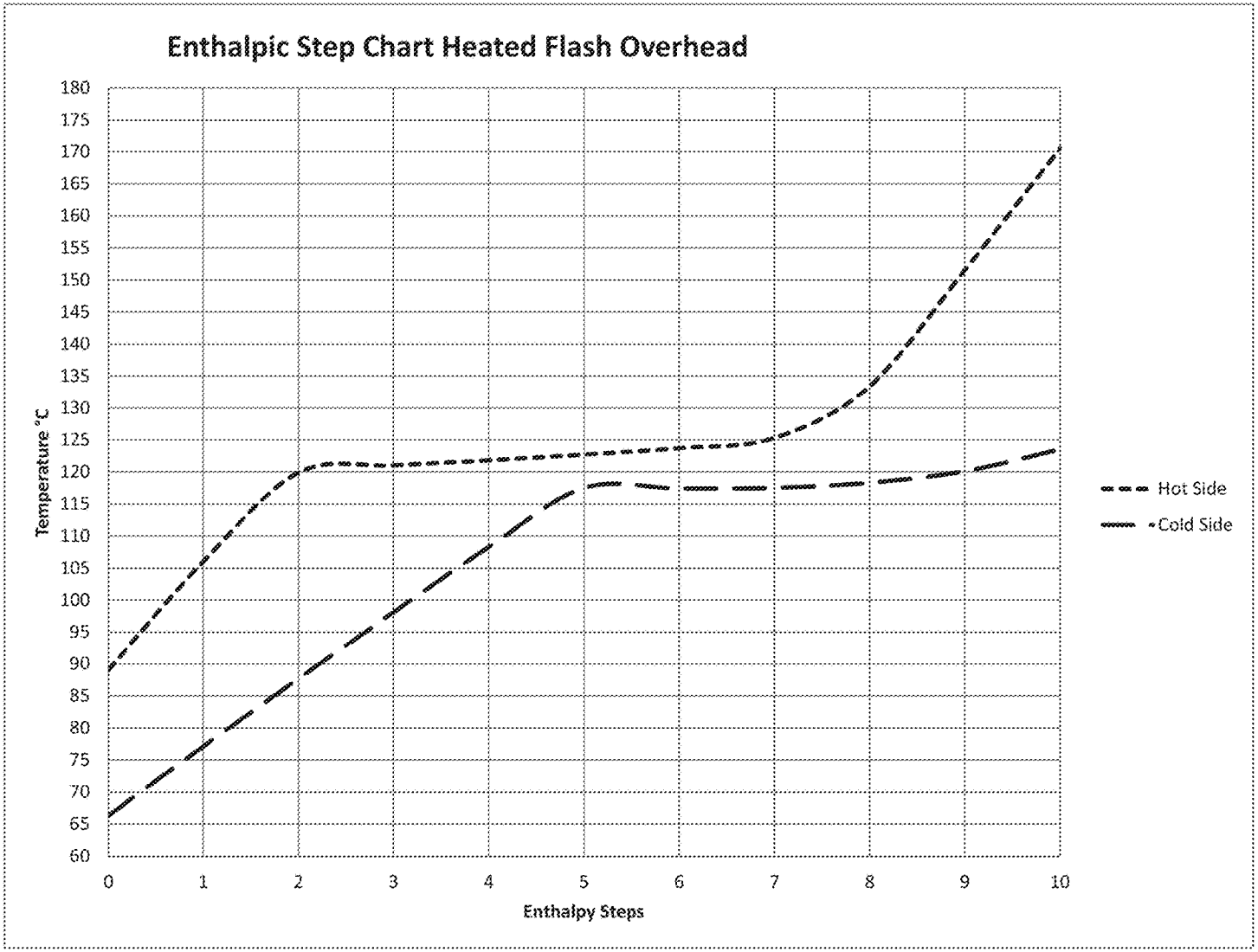
FIG. 17 is an enthalpic step chart for the overhead feed heat exchange from the heated flash vessel according to the embodiment shown in FIG. 2C.

With reference to FIGS. 2C, 3C and 17, to permit the heat integration, the process matches overhead condensation energy from the heated flash column 220 to some sensible heat and evaporation energy on the unheated flash underflow 24S to the heated flash column 220. In other words, the evaporation of the unheated flash underflow 24S is balanced with the condensation of the overhead solvent vapour stream 20V from heated flash column 220. In some embodiments, this is achieved by compressing the overhead solvent vapour stream 20V from heated flash column 220 using, for example, an integration compressor 224 (shown in FIG. 2C), to force the temperature of condensation to be above the bulk evaporation temperature of the column feed (i.e. the unheated flash underflow 24S). In the condensation step, the overhead solvent vapour stream 20V from the heated flash column 220 acts as a "refrigerant" to heat the unheated flash underflow 24S, which is the feed to the heated flash column 220. The result is removal of a temperature pinch and the exchange of roughly 12 times the energy that the compressor 224 consumes (heat pump circuit). In the embodiment shown in FIG. 3C, by adjusting the conditions in the heated flash, some form of heat integration can still be achieved (i.e. the solvent stream 20V acts as a heating medium to heat the underflow 24S) without the use of a compressor.

In some embodiments, as shown in FIG. 2C, after passing through heat exchanger 216, the overhead solvent vapour 20V from the heated flash vessel 220 is substantially completely condensed and is delivered to a separator 226. The separator 226 acts as a surge vessel and separates incondensible gases (e.g. $N_2$) from the solvent feed stream 20V. The resulting condensed solvent 20 from the separator 226 is then sent to solvent storage 32 (Stream B). In alternative embodiments, as shown for example in FIG. 3C, some or all of the overhead solvent vapour stream 20V exiting heat exchanger 216 is sent to a hot condensate storage 230 for subsequent delivery as the hot condensate stream 76 to the FSU (Stream D) for use in heat exchanger 74 for heating solvent 20 delivered thereto (FIG. 3B).

With reference to both FIGS. 2C and 3C, the underflow 24H from the heated flash vessel 220 are delivered to the stripping column 240 to recover the remaining solvent 20 in the third and final stage of the PSRU. The third stage aims to recover the remainder (about 8%) of the original solvent 20. The feed (i.e. the heated flash underflow 24H) to stripping column 240 is heated by heat integration with the underflow product bitumen stream 26 of the stripping column 240 and also with either a steam heater or a furnace.

In the embodiments shown in FIGS. 2C and 3C, prior to entering the stripping column 240, the heated flash underflow 24H is first heated by heat integration with the underflow product bitumen stream 26 from the stripping column 240 via a heat exchange apparatus 232. The preheated, heated flash underflow stream 24H exiting the heat exchanger 232 is then trimmed with steam to a desired temperature by a trim heater 234, prior to being delivered as feed to the stripping column 240. In a sample embodiment, the feed 24H immediately prior to entering the stripping column 240 is at about 230° C. and about 270 kPaa. The stripping column 240 is operated at around 270 kPaa, with solvent reflux to a top portion and the addition of the stripping steam to a bottom portion.

The temperature of the underflow product bitumen stream 26 upon exiting the stripping column 240, is from about 230° C. to about 250° C. The underflow product bitumen stream 26 is cooled by heat integration with the stripping column feed (i.e. the heated flash underflow 24H at heat exchange apparatus 232, the heated flash vessel feed (i.e. the unheated flash underflow 24S) at heat exchange apparatus 218, and a return solvent feed 20 at a heat exchanger 242, respectively. In the illustrated embodiments, the return solvent feed for use in heat exchanger 242 is from the solvent storage 32 (Stream C). After cooling, the underflow product bitumen stream 26, is blended with cool naphtha 30 and mixed using a static mixer 244. In a sample embodiment, the bitumen-naphtha mixture is at about 100° C. In a further embodiment, the naphtha is hydrotreated naphtha.

The bitumen-naphtha mixture is then trim cooled by a water cooler 246 prior to being delivered to a storage tank 248. In one embodiment, the bitumen-naphtha mixture is cooled to about 45° C. or lower for storage. Blending the bitumen with naphtha prior to storage makes the stored bitumen product more robust for handling and transportation. In embodiments, the blending is done at a dilution of about 5% with naphtha. In embodiments, butane 31 and additional naphtha 30 may be subsequently added to the bitumen-naphtha mixture for ease of transport from storage tank 248.

Overheads from the PSRU are condensed against cooling water, the feed to the heated flash vessel, and cooling water for the unheated flash, the heated flash, and the stripping column, respectively. The overhead solvent vapour stream 20V from the stripping column 240 is substantially completely condensed and may be tuned to a desired temperature by a trim heater or heat exchange apparatus 256 prior to being delivered to a separator 258 whereby water 34 in the overhead solvent vapour stream 20V is separated from the solvent 20. The separated water 34 is sent to the TSRU (Stream I) for mixing with the tailings stream 36 from separation vessel 16. The separated solvent 20 from the separator 258 is divided into a reflux stream 20F and a solvent return stream 20R. The reflux stream 20F is fed back into the top portion of stripping column 240 and the solvent return stream 20R is sent to the solvent storage 32 (Stream B). In some embodiments, the ratio of the reflux stream 20F to the solvent return stream 20R is about 0.7:1.

In an embodiment, as shown for example in FIGS. 2C and 3C, at least some solvent from solvent storage 32 (Stream C) is reheated against waste heat from the underflow bitumen product stream 26 from the stripping column 240 by heat exchanger 242 and, after exiting heat exchanger 242, the heated solvent 20 is further trim heated against steam to a desired temperature by a trim heater or heat exchange apparatus 80 prior to being delivered to the FSU (Stream C) for mixing with the underflow stream 22 from the first froth separation vessel 14 (as shown for example in FIG. 2B) and/or for mixing with froth 10 as feed to the first froth separation vessel 14, as shown for example in FIG. 3B.

In an alternative embodiment, as shown in FIG. 5, the solvent 20 from the solvent storage 32 may be reheated using sensible heat remaining in the intermediate fluid 68 in the heat pump 66, if used as the heating apparatus 54 for heating the froth 10 using heat in the tailings 46.

In general, an unheated flash step can be used in the first stage of solvent recovery after froth separation:

for the purpose of stabilizing the solvent-diluted bitumen, minimizing further precipitation of asphaltene from the bitumen in the PSRU; and/or for the purpose of reducing the temperature of the solvent-diluted bitumen to allow for heat integration.

As described above, the unheated flash step can recover around 25% to around 30% of the solvent 20 from the solvent-diluted bitumen 24 and the underflow 24S resulting from the unheated flash can be used to condense the overhead solvent vapour 20V from the subsequent solvent recovery stage.

In embodiments, the solvent storage 32 comprises a series of the storage bullets configured for universal receipt and storage, or for segregated storage of fresh and/or recycled solvent, as required.

TSRU

Having reference to FIGS. 2D and 3D and as described generally above, the tailings underflow stream 36 from the second froth separation vessel 16, or hydrocyclone 118 is fed to the TSRU (Stream E). The tailings 36 typically comprise water, asphaltenes, solids/minerals and residual solvent 20. In embodiments, water 34 separated in the PRSU (Stream I) is combined with the tailing underflow stream 36, allowing for further recovery of trace solvent therein.

In embodiments, the TSRU comprises at least one tailings solvent recovery vessel 38. More particularly, in embodiments, the TSRU comprises first and second TSRU vessels 38, 40, operated in series. Prior to delivery of the tailings stream 36 to the first TSRU vessel 38, the tailings 36 are heated using steam. Heating the tailings stream 36 can assist in keeping the asphaltenes liquid, particularly following flashing of the residual solvent 20 therefrom.

In the embodiment as shown in FIGS. 2D and 3D, the heated tailings stream 36 is pumped into the first TSRU vessel 38, which acts as a pumpbox. The pressure in the first TSRU vessel 38 is lower than a vapour pressure of the heated tailings stream 36 causing a portion of the tailings, including residual solvent 20, to flash therein, for removal from the pumpbox as an overhead vapour stream 300, as described in Applicant's Canadian patent application 2,940,145. By way of example, in the embodiment shown in FIG. 2D the pumpbox is at about 140 kPag.

The flashing of the tailings in the first TSRU 38 is more violent than the flash occurring in the second TSRU vessel 40. For this reason, internals within the first TSRU 38 are minimized, hence a pumpbox configuration is suitable. As the flash is less violent in the second TSRU, a conventional stripper column having additional internals is suitable.

The underflow stream 302 from the pumpbox 38, which may comprise residual solvent 20, is then pumped to the second TSRU vessel 40, which is typically a steam stripper column having steam introduced at a bottom thereof, to be flashed therein. An overhead pressure in the overhead vapour stream 300 is used to drive an ejector 304, which pulls the vapour from the stripper column 40 in a second overhead vapour stream 306 at a near neutral pressure of about 25 kPag. The ejector 304 also combines and pressurizes the overhead streams 300,306.

The embodiments allow for control of the TSRU using the overhead streams 300,306, thereby eliminating the need for modulating valves in the flashing service. Further, the overhead streams 300,306 are combined into one higher pressure stream for subsequent treatment. Embodiments of the TSRU reduce equipment count and result in a reduction in the flowsheet complexity.

Fixed pressure reduction elements can be used on the entry to the TSRU pumpbox 38 and stripper column 40 to control the feed pressure for said units, in conjunction with the overhead system pressure control.

Preheating of the tailings stream 36 prior to solvent recovery in the TSRU can also act to generate sufficient vapour to properly drive the ejector 304 for combining the overheads 300,306 from the first and second TSRU vessels 38, 40 at different pressures.

In the embodiment shown in FIG. 2D, the overhead streams 300, 306 are combined prior to condensation. The net vapour is delivered to an overhead (O/H) condenser 307 and condensed against cooling water and then separated in a separation vessel 309, such as at about 70 kPag to produce an overhead vapour stream 311 for delivery to the VRU (Stream F) for further processing and solvent 20 as an underflow stream for delivery to solvent storage 32 (Stream K).

In the embodiment shown in FIG. 3D, the combined overhead streams 300, 306 are delivered from the ejector 304 to the VRU (Stream F), for further processing In embodiments, shown in FIGS. 2A, 2D, 3A and 3D, the first TSRU vessel 38 comprises two sets of primary nozzles, each set comprising a plurality of the nozzles therein. The primary nozzles are sized to deliver the tailings stream 36 pumped thereto into the first TSRU vessel 38. One set of primary nozzles is redundant and is maintained for backup in case of failure of nozzles in the other set of primary nozzles. Should nozzles in the first set of nozzles fail, the second set of primary nozzles are put into service. The second TSRU vessel 40 comprises two sets of nozzles, a set of primary nozzles sized to deliver the tailings stream 36 and a set of secondary nozzles of a smaller size relative to the primary nozzles and suitable for delivering the underflow stream 302 from the first TSRU 38 to the second TSRU vessel 40. In normal operation, the set of secondary nozzles are used deliver the underflow stream 302 to the second TSRU vessel. The set of primary nozzles in the second TSRU vessel 40 are maintained for backup should the first TSRU vessel 38 need to be taken off-line for repair, such as to replace nozzles therein.

In the case where the first TSRU 38 is taken offline, the tailings stream 36 is fed to a first bypass line 314, which is fluidly connected to the primary nozzles in the second TSRU 40 to allow the tailings stream 36 to be delivered thereto, bypassing the first TSRU 38. A second bypass line 316 delivers the overhead stream 306 from the second TSRU 40 to condenser 307, bypassing the ejector 304.

In the case where the second TSRU 40 is taken offline, a third bypass line 318 delivers the underflow 302 from the first TSRU 38 for disposal, or for heating the froth 10 in the FSU prior to disposal.

As a majority of the residual solvent is removed in a single stage of flash, should the first TSRU vessel be taken off-line, solvent 20 lost to the tailings underflow stream 46 from the second TSRU vessel 40 in this case is generally not significant.

Utility water W is sprayed into the first and second TSRU vessels 38,40 to wet a demister therein for efficiently separating mist therefrom.

As shown in FIG. 3D, the underflow stream 302 from the first TSRU vessel 38 and the underflow stream 46 from the second TSRU 40 can be recycled back into the first and second TSRU vessels respectively using return lines 310 and 312.

VRU

The VRU 400 collects, condenses and stores residual paraffinic solvent from the overhead (vapour) streams from the FSU, PSRU and TSRU. FIGS. 2E and 3E show alternative embodiments for processing vapour in the VRU. In the VRU, Applicant prefers to do most of the energic condensation (that is, the rejection of heat) to water. The alternative embodiments differ with respect to the extent to which compressors are used, as compressors are capital and maintenance intensive as compared to heat exchangers. Where low cost cooling water is readily available, the embodiment of FIG. 3E, which relies on isothermal compression using water as the liquid coolant to absorb the heat generated, is preferred.

In the embodiment of the VRU 400 shown in FIG. 2E, compression energy is minimized by sequential compression, condension and separation of the streams as the pressure increases. First, the pressure of the vapour stream (Stream I) from the TSRU is further increased by blower 402, which in an embodiment is a lobe blower, and then by medium pressure (MP) compressor 404, which in an embodiment is a liquid ring compressor. The net vapour stream from the unheated flash in the PSRU [Stream H] may enter the vapour stream of the VRU downstream of blower 402 and upstream of MP compressor 404.

The vapour stream exiting compressor 404 may then be cooled against cooling water in exchanger 406 to partially condense the vapour and delivered to a first pressurized vertical gas-liquid separator 408. The purge gas stream from the FSU [Stream G] may enter the vapour stream of the VRU downstream of MP compressor 404 and upstream of exchanger 406. Thus, in embodiments the combined vapour stream from the FSU, PSRU and TSRU is cooled by exchanger 406 and delivered to the first separator 408.

The pressure of the vapour stream 409 exiting first separator 408, is again increased, for example by a High Pressure (HP) compressor 410, which in embodiments is a screw compressor. The vapour stream is then chilled by chiller package 420 to partially condense the vapour, and separated in a second and final pressurized vertical gas-liquid separator 412.

Chiller package 420 is a closed loop system that comprises a heat exchanger 422 and a vapour-compressor 424. Coolant is evaporated through the heat exchanger 422, to cool the vapour stream. The heated coolant is then circulated to the vapour-compressor 424 and condensed against air, for cooling. In an embodiment the coolant is propane.

The liquid solvent 426,20 from the first separator 408 is pumped and combined with the liquid solvent 428,20 from the second separator 412, and delivered to the solvent surge and storage system 32.

Any vapour 430 remaining after second separator 412 is delivered to the plant fuel gas FG system for use in boilers.

An alternative embodiment of the VRU processes, shown in FIG. 3E, uses isothermal compression with internal cooling by water, rather than sequential compressing, condensing and separating, to recover solvent.

The net vapour stream from the unheated flash in the PSRU [Stream H] and the purge gas stream from the FSU [Stream G] are combined and delivered to a Joule-Thomson Valve 440 that expands the incoming vapour stream thereby reducing its pressure and temperature. The pressure is reduced to approximately the pressure of the vapour stream that is discharged from ejector 304 of the TSRU, typically about 170 KPaa. The temperature of the vapour is typically reduced by the Joule-Thomson Valve 440, reducing downstream cooling requirements.

The combined overhead stream 300,306 from the ejector 304 is combined with the vapour stream 442 discharged from the Joule-Thomson Valve 440, and this combined stream 444 is cooled against cooling water in exchanger 446 and partially condensed before delivery to a separator 448 (with demister). The liquid solvent 450,20 from demisting the separator 448 is delivered to the solvent surge and storage system 32. In embodiments the temperature of the vapour entering and exiting the demisting condenser 448 is about 28° C.

The vapour stream 449 exiting the separator 448 is subjected to isothermal compression by isothermal compressor 451, which condenses some solvent by direct contact with water and requires less compression energy as compared to some other compressors. Water is used as the liquid coolant to absorb the heat generated by compression of the vapour and condensation of the solvent during compression. The compression target is driven by the ability to condense against the downstream refrigerant at approximately 5° C. and the fuel gas system pressure requirements. The lower the exit temperature the less heat is delivered to the chiller system. In embodiments, isothermal compression increases the pressure of the vapour stream from about 126 KPaa to about 935 KPaa.

In one embodiment, compressor 451 is a liquid ring compressor. A liquid ring compressor comprises a vaned impeller located eccentrically within a cylindrical casing. Water is fed into the case of the compressor and forms a moving cylindrical ring against the inside of the casing. The vapour stream is drawn into the pump through an inlet port and trapped in compression chambers formed by the impeller vanes and the liquid ring.

In another embodiment compressor 451 is a multiphase pump, such as twin screw pump, progressive cavity pump or double acting piston pump. A twin-screw pump is preferred. These are rotary positive displacement pumps that consist of two intermeshing screws which form a series of chambers. As the screws rotate, these chambers move the multiphase fluid from the low pressure suction (inlet) ends of the pump towards the higher pressure discharge (outlet) in the center of the pump.

In yet another embodiment, compressor 451 is a gas-liquid ejector nozzle (e.g., obtained from Transvac Systems Ltd.). In this embodiment, high pressure water is used as the motive/primary fluid, to boost the pressure of the vapour stream.

The compressed vapour/water stream exiting the isothermal compressor 451 is delivered to a 3-phase pressurized separator 452 (e.g., a condensate drum) to separate liquid water from liquid solvent from residual vapour. Liquid water is cooled in exchanger 454 and recycled back to compressor 451 feed. Residual vapour 453 is delivered to a chiller package 420.

Chiller package 420 is a closed loop system that comprises a heat exchanger 422 and a vapour-compressor 424. Coolant is evaporated through the heat exchanger 422, to cool the vapour stream. The heated coolant is circulated to the vapour-compressor 424 and condensed against air for cooling. In an embodiment, the coolant is propane. The chilled vapour is delivered to a second and final pressurized vertical liquid-gas separator 456.

Liquid solvent 458, 20 from the 3-phase separator 452 is pumped and combined with the liquid solvent 460, 20 from the second separator 456, and delivered as solvent stream 432 to the solvent surge and storage system 32. Any vapour 430 remaining after second separator 456 is delivered to the plant fuel gas system for use in boilers.

Solvent surge and storage system 32 comprises one or more pressurized storage bullets 502 that receive and hold recycled solvent from the PSRU (Stream B) and from solvent stream 432 from the VRU. The solvent storage bullets 502 may also receive fresh pentane 504, 20 from a solvent preparation unit (SPU), may deliver solvent 506, 20 to the FSUs (stream C), and may receive solvent 508, 20 from or deliver solvent 510, 20 to trucks T.

In embodiments, a froth separation vessel for a high temperature paraffinic froth treatment process comprises: a vessel having a cylindrical portion, a conical bottom and a semispherical top; an inlet pipe extending substantially vertically within a center of the vessel from the top to about a transition between the cylindrical portion and the conical bottom; a feedwell fluidly connected to a bottom of the inlet pipe for delivering paraffinic solvent-diluted bitumen-containing froth to the vessel; a collector pot supported concentrically about the inlet pipe, at or about a top of a separation zone in the cylindrical portion, for collecting and discharging an overflow stream therefrom; a surge volume in the cylindrical portion above the separation zone; and an outlet in the conical bottom for discharging an underflow stream therefrom. In embodiments, the collector pot comprises: a cylindrical collection chamber having a closed top, an open bottom; and a discharge conduit fluidly connected from the collection chamber to outside the vessel.

In embodiments, the froth separation vessel of further comprises: liquid level control for controlling the liquid level in the vessel, wherein a normal liquid level is at or about the top of the collector pot.

In embodiments, a height of the separation zone is about 1.2 times a diameter of the cylindrical portion.

In embodiments, a froth separation vessel for a high temperature paraffinic froth treatment process comprises: a vessel having a cylindrical portion, a conical bottom and a semispherical top; an inlet pipe extending substantially vertically within a center of the vessel from the top to about a transition between the cylindrical portion and the conical bottom; a nozzle arrangement fluidly connected to a bottom of the inlet pipe for delivering paraffinic solvent-diluted bitumen-containing froth to the vessel; a collector ring supported toroidally about the inlet pipe, at or about a top of a separation zone in the cylindrical portion, for collecting and discharging an overflow stream therefrom; a surge volume in the cylindrical portion above the separation zone; and an outlet in the conical bottom for discharging an underflow stream therefrom.

In embodiments, the nozzle arrangement comprises: pairs of opposing nozzles, fluidly connected to the inlet pipe, the nozzles arranged symmetrically about a circumference of the vessel at about the transition, each nozzle being angled to create a flow of solvent-diluted froth in a horizontal plane therefrom to oppose a flow of solvent-diluted froth in the same horizontal plane from a nozzle in an adjacent pair of opposing nozzles.

In embodiments, the nozzle arrangement further comprises: feed pipes for fluidly connecting the pairs of opposing nozzles to the inlet pipe, each feed pipe angled downwardly from the inlet pipe at an angle of about 135 degrees relative to the inlet pipe.

In embodiments, the nozzle arrangement comprises three pairs of opposing nozzles, the pairs of nozzles being spaced circumferentially about the vessel spaced about 120 degrees apart.

In embodiments of the froth separation vessel, the collector ring comprises: a pipe supported toroidally about the inlet pipe at about a top of the collection zone; a plurality of inlet apertures in a lower surface of the pipe for collecting the overflow thereat; and a discharge outlet fluidly connected to the pipe for discharging the overflow outside the vessel.

We claim:

1. A process of heat integration in a paraffinic solvent recovery unit having a first flash vessel, operating at a first temperature, and a second flash vessel, operating at a second temperature higher than the first temperature, and comprising:

delivering a paraffinic solvent-diluted bitumen froth overflow stream from a froth setting unit, without heating, to the first flash vessel, wherein the first flash vessel is unheated, flashing the paraffinic solvent-diluted bitumen froth feed stream in the first vessel for producing:

a first overhead solvent vapour stream; and a first underflow stream;

feeding the first underflow stream to the second flash vessel;

flashing the first underflow stream in the second flash vessel for producing a second overhead solvent vapour stream; and a second underflow stream;

heating the first underflow stream prior to feeding the first underflow stream to the second flash vessel, with a heat pump circuit, wherein heat from the second overhead solvent vapour stream provides heat for the heat pump circuit for exchanging heat therein to the first underflow stream.

2. The process of claim 1 comprising:

passing the second overhead solvent vapour stream through a compressor to form the heat pump circuit, thereby compressing the second overhead solvent vapour stream to force a temperature of condensation therein to be above a bulk evaporation temperature of the first underflow stream; and exchanging heat from the second overhead vapour stream to the first underflow stream by condensing the compressed second overhead solvent vapour stream against the first underflow stream.

3. The process of claim 1 further comprising:

steam stripping the second underflow stream in a stripping column for producing a third overhead solvent vapour stream; and a third underflow stream comprising at least the bitumen; and exchanging heat from the third underflow stream to the second and first underflow streams.

4. The process of claim 2 further comprising:

steam stripping the second underflow stream in a stripping column for producing a third overhead solvent vapour stream; and a third underflow stream comprising at least the bitumen; and exchanging heat from the third underflow stream to the second and first underflow streams.

5. The process of claim 3 wherein the stripping column is operated at about 270 kPa, and the temperature and pressure of the second underflow stream is about 230° C. and about 270 kPa, respectively, immediately prior to entering the stripping column.

6. The process of claim 4 wherein the stripping column is operated at about 270 kPa, and the temperature and pressure of the second underflow stream is about 230° C. and about 270 kPa, respectively, immediately prior to entering the stripping column.

7. The process of claim 5 wherein the temperature of the third underflow stream upon exiting the stripping column is from about 230° C. to 250° C.

8. The process of claim 6 wherein the temperature of the third underflow stream upon exiting the stripping column is from about 230° C. to 250° C.

9. The process of claim 3 further comprising trim heating the second underflow stream to operational temperatures prior to entering the stripping column.

10. The process of claim 1 further comprising trim heating the first underflow stream to operational temperatures prior to entering the second flash vessel.

11. The process of claim 1 wherein the first underflow stream has a temperature of about 172° C. and a pressure of about 1200 kPa upon entering the second flash column.

12. The process of claim 2 wherein the first underflow stream has a temperature of about 172° C. and a pressure of about 1200 kPa upon entering the second flash column.

13. The process of claim 1 wherein the paraffinic solvent-diluted bitumen froth feed stream has a temperature of about 90° C. and mass ratio of solvent to bitumen of about 1:8.

14. The process of claim 2 wherein the paraffinic solvent-diluted bitumen froth feed stream has a temperature of about 90° C. and mass ratio solvent to bitumen of about 1:8.

15. The process of claim 1 further comprising passing the first overhead solvent vapour stream to a separator, to separate net solvent vapour from condensed solvent.

16. The process of claim 1 further comprising passing the second overhead solvent vapour stream to a separator, to separate incondensable gases from the condensed solvent.

17. The process of claim 1 further comprising passing the second overhead solvent vapour stream to hot condensate storage.

18. The process of claim 1 wherein the heat pump circuit further comprises a secondary refrigerant, the process further comprising:

exchanging heat from the second overhead vapour stream fluid to the secondary refrigerant;

compressing the secondary refrigerant;

transferring heat from the secondary refrigerant to the first underflow stream, thereby evaporating the solvent in the first underflow stream.

19. The process of claim 18 further comprising:

steam stripping the second underflow stream in a stripping column for producing a third overhead solvent vapour stream; and a third underflow stream comprising at least the bitumen; and exchanging heat from the third underflow stream to the second and first underflow streams.

* * * * *